US010060065B2

(12) United States Patent
Yoneda et al.

(10) Patent No.: US 10,060,065 B2
(45) Date of Patent: Aug. 28, 2018

(54) DRUM WASHING MACHINE

(71) Applicants: HAIER ASIA CO., LTD., Tokyo (JP); QINGDAO HAIER WASHING MACHINE CO., LTD., Shandong (CN)

(72) Inventors: Masanori Yoneda, Tokyo (JP); Hiroyuki Tanaka, Tokyo (JP)

(73) Assignees: Haier Asia Co., Ltd., Tokyo (JP); Qingdao Haier Washing Machine Co., Ltd., Shandong (CN)

( * ) Notice: Subject to any disclaimer, the term of this patent is extended or adjusted under 35 U.S.C. 154(b) by 0 days.

(21) Appl. No.: 15/501,432

(22) PCT Filed: Aug. 4, 2015

(86) PCT No.: PCT/CN2015/086076
§ 371 (c)(1),
(2) Date: Feb. 2, 2017

(87) PCT Pub. No.: WO2016/019858
PCT Pub. Date: Feb. 11, 2016

(65) Prior Publication Data

US 2017/0233923 A1 Aug. 17, 2017

(30) Foreign Application Priority Data

Aug. 4, 2014 (JP) ..... 2014-158954

(51) Int. Cl.
*D06F 23/02* (2006.01)
*D06F 23/06* (2006.01)
(Continued)

(52) U.S. Cl.
CPC ..... *D06F 37/065* (2013.01); *D06F 23/02* (2013.01); *D06F 23/06* (2013.01); *D06F 33/02* (2013.01);
(Continued)

(58) Field of Classification Search
CPC ..... D06F 23/02; D06F 23/06; D06F 33/02; D06F 37/065; D06F 37/304; D06F 37/40;
(Continued)

(56) References Cited

U.S. PATENT DOCUMENTS

2006/0081018 A1* 4/2006 Kim ..... D06F 37/065 68/17 R
2013/0111676 A1* 5/2013 Jun ..... H02K 21/12 8/137

FOREIGN PATENT DOCUMENTS

CN 1746378 A 3/2006
CN 1746398 A 3/2006
(Continued)

OTHER PUBLICATIONS

International Search Report dated Sep. 22, 2015 from International Patent Application No. PCT/CN2015/086076, filed Aug. 4, 2015.
(Continued)

*Primary Examiner* — Levon J Shahinian
(74) *Attorney, Agent, or Firm* — Sunstone IP

(57) ABSTRACT

Disclosed is a drum washing machine, including: a drum configured in an outer tank and capable of rotating by using an inclination axis as center; a stirring body configured at a rear part of the drum and including main blades in contact with washings; a driving unit enabling the drum and the stirring body to rotate at different rotating speeds; and a water supply mechanism part configured to splash water to a surface of the stirring body. The water supply mechanism part includes a first water storage part capable of moving between a position in water soaked in the outer tank and a position higher than the water and storing water when soaked in water of the outer tank, and a first outflow port
(Continued)

capable of enabling water stored in the first water storage part to flow out to the surface of the stirring body at an upper position.

8 Claims, 26 Drawing Sheets

(51) Int. Cl.

| | |
|---|---|
| ***D06F 33/02*** | (2006.01) |
| ***D06F 37/06*** | (2006.01) |
| ***D06F 37/30*** | (2006.01) |
| ***D06F 37/40*** | (2006.01) |
| ***D06F 39/00*** | (2006.01) |
| ***D06F 39/02*** | (2006.01) |
| ***D06F 39/08*** | (2006.01) |

(52) U.S. Cl.
CPC ..... *D06F 37/304* (2013.01); *D06F 37/40* (2013.01); *D06F 39/005* (2013.01); *D06F 39/02* (2013.01); *D06F 39/083* (2013.01); *D06F 39/087* (2013.01); *D06F 39/088* (2013.01)

(58) Field of Classification Search
CPC ..... D06F 39/005; D06F 39/02; D06F 39/083; D06F 39/087; D06F 39/088
USPC ..... 68/24, 58, 131, 140
See application file for complete search history.

(56) References Cited

FOREIGN PATENT DOCUMENTS

| | | | |
|---|---|---|---|
| CN | 1760425 | A | 4/2006 |
| CN | 102851916 | A | 1/2013 |
| JP | 2013240577 | A | 12/2013 |
| KR | 20060033588 | A | 4/2006 |

OTHER PUBLICATIONS

Korean Office Action dated Nov. 30, 2017 from International Patent Application No. PCT/CN2015/086076, filed Aug. 4, 2015.

* cited by examiner

B-B' sectional view

A-A' sectional view

C-C' sectional view

DRUM WASHING MACHINE

CROSS REFERENCE TO RELATED APPLICATION(S)

This application is a U.S. National Stage Entry of International Patent Application No. PCT/CN2015/086076, filed Aug. 4, 2015, which claims the benefit of Japanese Patent Application No. JP 2014-158954, filed Aug. 4, 2014, the disclosures of which are hereby incorporated entirely herein by reference.

BACKGROUND

Technical Field

The present disclosure relates to drum washing machine, which not only can be continuously operated from washing to drying, but also can carry out washing without drying.

State of the Art

In the past, a drum washing machine rotates a transverse-shaft type drum in an outer tank which stores water at the bottom, washings are lifted up and dropped down by baffles arranged in the drum, and the washings are thrown to an inner circumferential surface of the drum to realize washing (with reference to patent literature 1).

In this way, in a structure of stirring the washings by the baffles, the washings are difficult to twine or rub against each other. Therefore, compared with an automatic washing machine which washes the washings through rotation of a pulsator in a washing and dewatering tank, the drum washing machine has mechanical force, acting on the washings, easy to get small, and has detergency easy to lower.

Therefore, in the drum washing machine, in order to improve the detergency, a structure that a stirring body with is arranged at the rear part of the drum may be adopted, so that the drum and the stirring body can respectively rotate at different rotating speeds when in washing and rinsing.

CURRENT TECHNICAL LITERATURE

Patent Literature

Patent Literature 1: Japanese Laid-Open Patent Publication No. 2013-240577

SUMMARY

Problems to be Solved in the Disclosure

When in washing, the washings are often thrown into the drum in a dry state. Under the condition that many dry washings are contained in the drum, a state that the washings are compressed between a door on a front surface of the drum and the stirring body on the rear of the drum and the stirring body is compressed by the washings may occur. In addition, when the washings and the stirring body are in a dry state, a friction coefficient is higher than that in a wetted state. Therefore, in this way, in the state that the stirring body is compressed by dry washings, when the drum and the stirring body respectively rotate, a large load from the washings is applied to the stirring body, and a driving motor for driving the stirring body may be locked.

The present disclosure accomplishes a technical solution in view of the above problems, and aims to provide a drum washing machine capable of realizing improvement of cleaning performance and preventing poor operation of a driving part and other faults from occurring.

Solution for Solving the Problems

A drum washing machine in a main embodiment of the present disclosure includes: an outer tank, configured in a shell; a drum, configured in the outer tank and capable of rotating by using a horizontal axis or an inclination axis inclining relative to a horizontal direction as a center; a rotating body, configured at a rear part of the drum and provided with a protruding part in contact with washings on a surface of the rotating body; a driving part, configured to enable the drum and the rotating body to rotate at different rotating speeds; and a water supply mechanism part, capable of splashing water to the surface of the rotating body.

According to the above structure, the water supply mechanism part splashes water to the surface of the rotating body, so as to wet the rotating body and washings in contact with the rotating body, thereby reducing a friction coefficient of the rotating body and the washings. Therefore, a load applied to the rotating body due to contact with the washings can be reduced, thereby avoiding faults that a motor of the driving part is locked and the like.

In the drum washing machine in this mode, the water supply mechanism part can adopt a structure including a water storage part and an outflow port, wherein the water storage part moves between a position of water soaked in the outer tank and a position higher than the water in the outer tank, and is configured to store water when soaked in water of the outer tank; and the outflow port is configured on the water storage part and is capable of enabling the water stored in the water storage part to flow out to the surface of the rotating body at an upper position.

According to the above structure, the water stored in the outer tank can be drawn up from the water storage part and splashed to the surface of the rotating body, and the surface of the rotating body and the like can be wetted by utilizing the water in the outer tank.

Further, a structure that the water storage part is configured at a rear or on an inner circumferential surface of the drum and moves through rotation of the drum may be adopted under the condition that the above structure is adopted.

Since the water in the outer tank can be drawn upwards by utilizing rotation of the drum with the adoption of the structure, the water in the outer tank can be easily utilized.

Further, a structure that the water supply mechanism part includes an intake port configured at the water storage part and capable of taking the water in the outer tank into the water storage part may be adopted under the condition that the above structure is adopted. In this case, a structure that the intake port is opened to an advancing direction side of the drum while rotating may be adopted.

With the adoption of this structure, when the water storage part is immersed into water due to rotation of the drum, the water easily flows into the water storage part via the intake port, so that the water is easily stored in the water storage part.

Further, a structure that guide ribs are configured in the water storage part may be adopted under the condition that a structure that the water supply mechanism part includes the water storage part and the outflow port is adopted, wherein the guide ribs guide the water to the outflow port when the water flows out of the outflow port.

Since the water in the water storage part can be smoothly guided to the outflow port by the guide ribs with the adoption of the structure, the water can be enabled to flow out of the outflow port towards the rotating body.

The protruding part may further adopt following structures under the condition that a structure that the water supply mechanism part includes the water storage part and the outflow port is adopted: extending radially from center of the rotating body to the outer circumference part of water soaked in the outer tank, and a recess part is formed in the back corresponding to the protrusion on the surface. In this case, the water storage part is composed to include the recess part and moves through rotation of the rotating body, and the outflow port is formed in the recess part.

When this structure is adopted, in order to enable the wall thickness of the protruding part to be uniform, the recess part on the back of the rotating body inevitably acts on the water storage part, so the water supply mechanism part can be simply and conveniently realized. Moreover, since water can be upwards drawn into the outer tank by utilizing rotation of the rotating body, the water in the outer tank can be easily utilized.

Further, a structure that hollow baffles are configured on the inner circumferential surface of the drum may be adopted under the condition that a structure that the water supply mechanism part includes the water storage part and the outflow port is adopted. In this case, a structure that the water storage part includes the baffles and moves through rotation of the drum may be adopted, and on the baffles, the outflow port is formed in a position where water flowing out of the outflow port is splashed to the surface of the rotating body.

With the adoption of the structure, in order to stir the washings, the baffles serve as the water storage part, so the water supply mechanism part can be simply and conveniently realized. Moreover, since water can be upwards drawn into the outer tank by utilizing rotation of the drum, the water in the outer tank can be easily utilized.

Effects of the Disclosure

According to the present disclosure, a drum washing machine can be provided, capable of realizing improvement of cleaning performance and preventing poor operation of the driving part and other faults from occurring.

Effects and significances of the present disclosure are further clarified by embodiments shown below. However, the following embodiments are just an illustration when the present disclosure is implemented, and the present disclosure is not limited by any content recorded in the following embodiments.

DETAILED DESCRIPTION

Hereinafter, a drum washing machine without a drying function as an embodiment of the drum washing machine in the present disclosure is described by referring to drawings.

Figure 1:
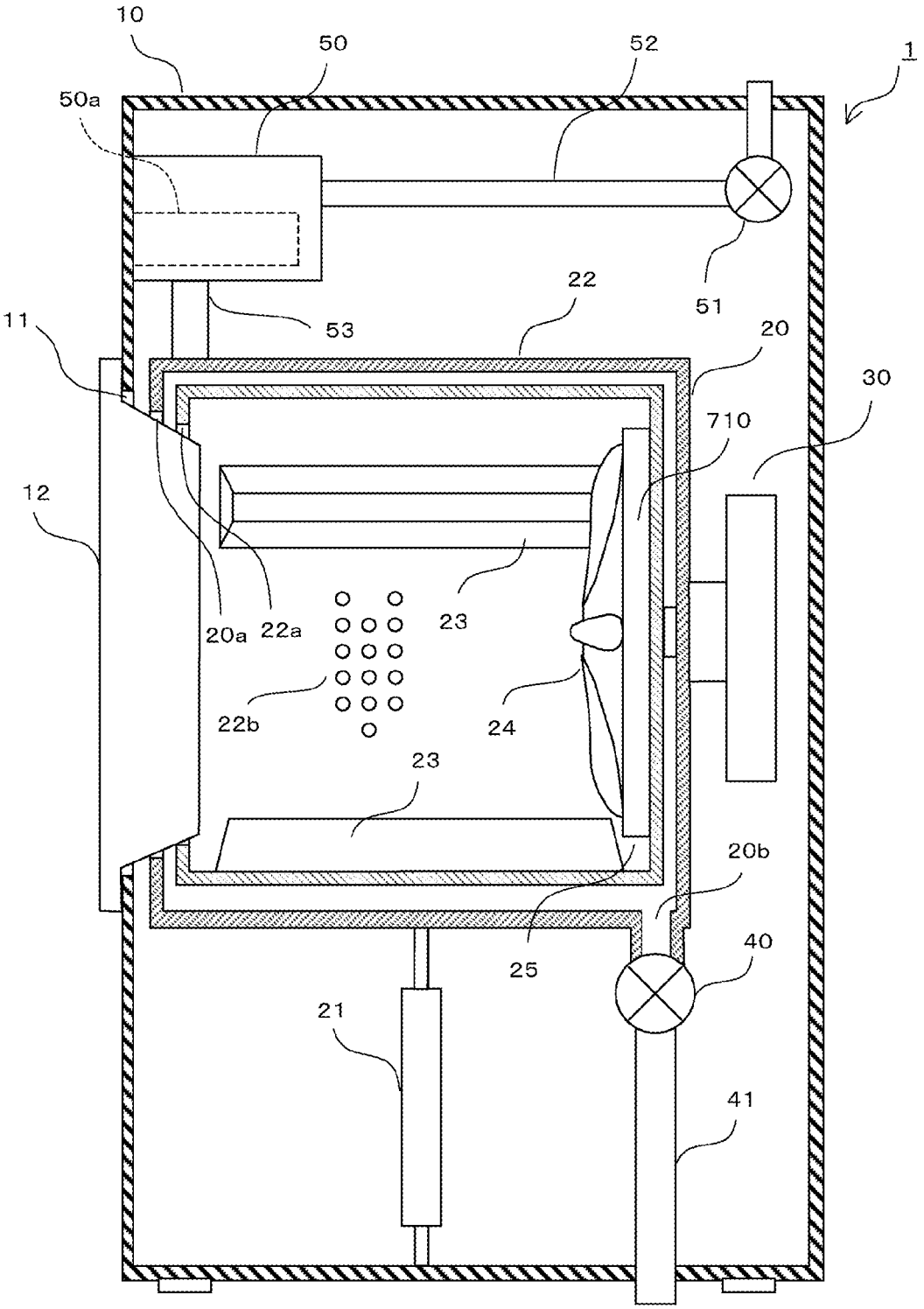
FIG. 1 is a side sectional view illustrating a structure of a drum washing machine in embodiments.

FIG. 1 is a side sectional view illustrating a structure of a drum washing machine 1.

The drum washing machine 1 includes a shell 11 forming an appearance. A throwing inlet 11 of the washings is formed in a front surface of the shell 10. The throwing inlet 11 is covered by a door 12 which is freely opened and closed.

An outer tank 20 is elastically supported by a plurality of vibration dampers 21 in the shell 10. A drum 22 is configured in the outer tank 20 in a free rotation manner and can rotate by taking a horizontal axis as a center. An opening part 20*a* on the front surface of the outer tank 20 and an opening part 22*a* on the front surface of the drum 22 are opposite to the throwing inlet 11, and are locked by the door 12 with the throwing inlet 11. A plurality of dewatering holes 22*b* are formed in the inner circumferential surface of the drum 22. Further, three baffles 23 are arranged in the circumferential direction at roughly equal intervals on the inner circumferential surface of the drum 22.

A stirring body 24 is configured at the rear of the drum 22 in a free rotation manner. The stirring body 24 has a roughly disc shape and coaxially rotates with the drum 22. The stirring body 24 is equivalent to a rotating body of the present disclosure. Further, a retainer unit 25 is configured at the rear of the drum 22. The retainer unit 25 is formed into a ring and includes a retainer 710 surrounding the stirring body 24. The retainer 710 is capable of preventing the washings from being bitten into a gap formed between the stirring body 24 and the drum 22. Specific structures of the stirring body 24 and the retainer unit 25 are described below.

A driving unit 30 capable of generating a torque for driving the drum 22 and the stirring body 24 is configured at the rear of the outer tank 20. The driving unit 30 is equivalent to a driving part of the present disclosure. The driving unit 30 enables the drum 22 and the stirring body 24 to rotate at different rotating speeds in the same direction in a washing process and a rinsing process. Specifically, the driving unit 30 enables the drum 22 to rotate at a rotating speed through which centrifugal force applied to the washings in the drum 22 is smaller than gravity, and the stirring body 24 rotates at a rotating speed higher than the rotating speed of the drum 22. On the other hand, the driving unit 30 enables the drum 22 and the stirring body 24 to integrally rotate at a rotating speed through which the centrifugal force applied to the washings in the drum 22 is larger than the gravity while dewatering. A specific structure of the driving unit 30 is described below.

A water outlet part 20*b* is formed in the bottom of the outer tank 20. A drainage valve 40 is configured in the water outlet part 20*b*. The drainage valve 40 is connected with a drainage hose 41. When the drainage valve 40 is opened, water stored in the outer tank 20 is discharged out of the machine by the drainage hose 41.

A detergent box 50 is configured on the upper part of the front in the shell 10. A detergent container 50*a* containing detergents is contained in the detergent box 50 from the front in a free withdrawal manner. The detergent box 50 is connected with a water supply valve 51 configured on the upper part at the rear in the shell 10. In addition, the detergent box 50 is connected with the upper part of the outer tank 20 through a water injection pipe 53. When the water supply valve 51 is opened, running water from a faucet is supplied into the outer tank 20 by virtue of a water supply hose 52, the detergent box 50 and the water injection pipe 53. At this moment, the detergents contained in the detergent container 50*a* are supplied into the outer tank 20 along with a water flow.

Then, a structure of the driving unit 30 is described in detail.

Figure 2:
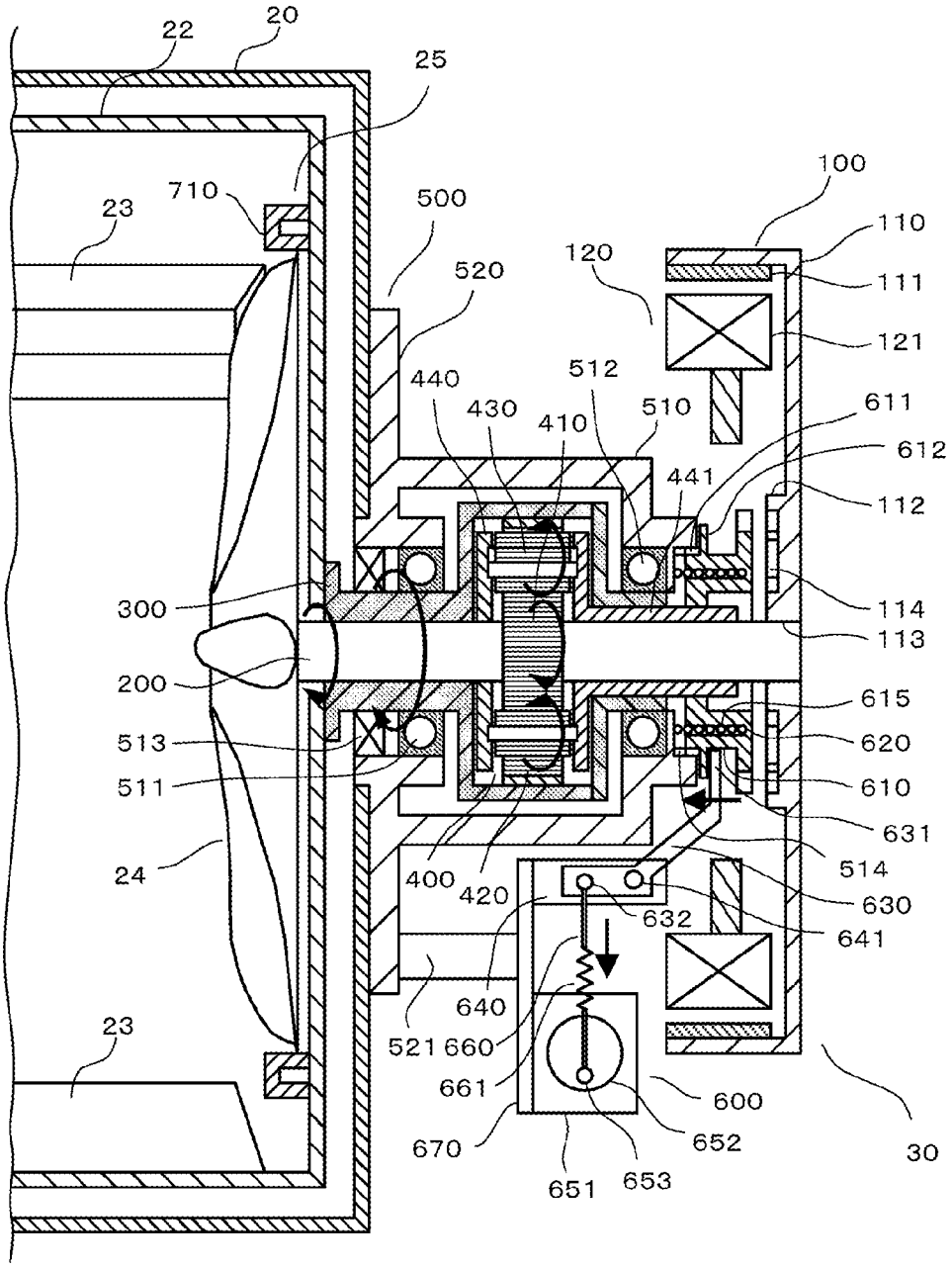
FIG. 2 is a sectional view illustrating a structure of a driving unit in embodiments.
Figure 3:
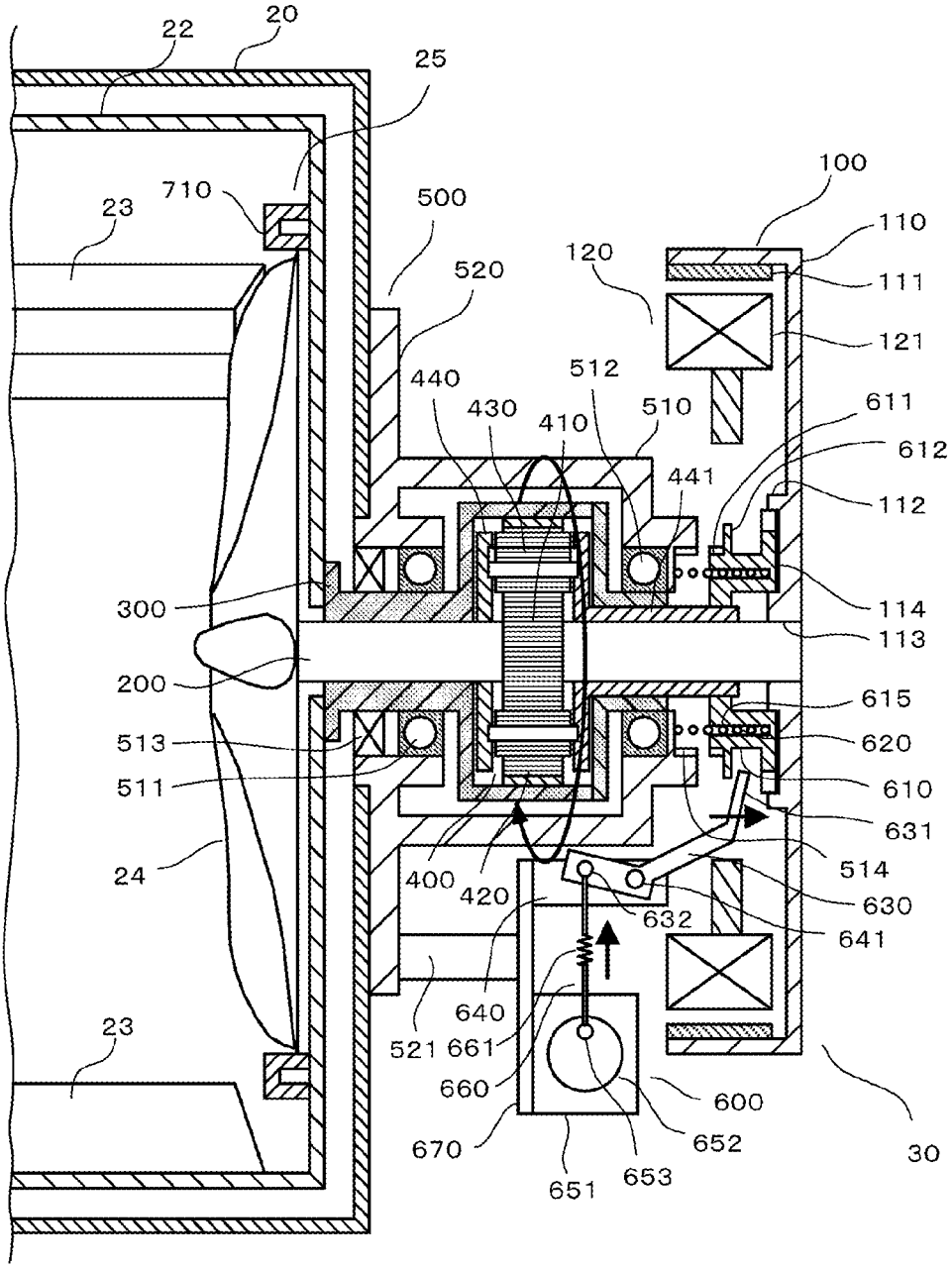
FIG. 3 is a sectional view illustrating a structure of a driving unit in embodiments.
Figure 4:
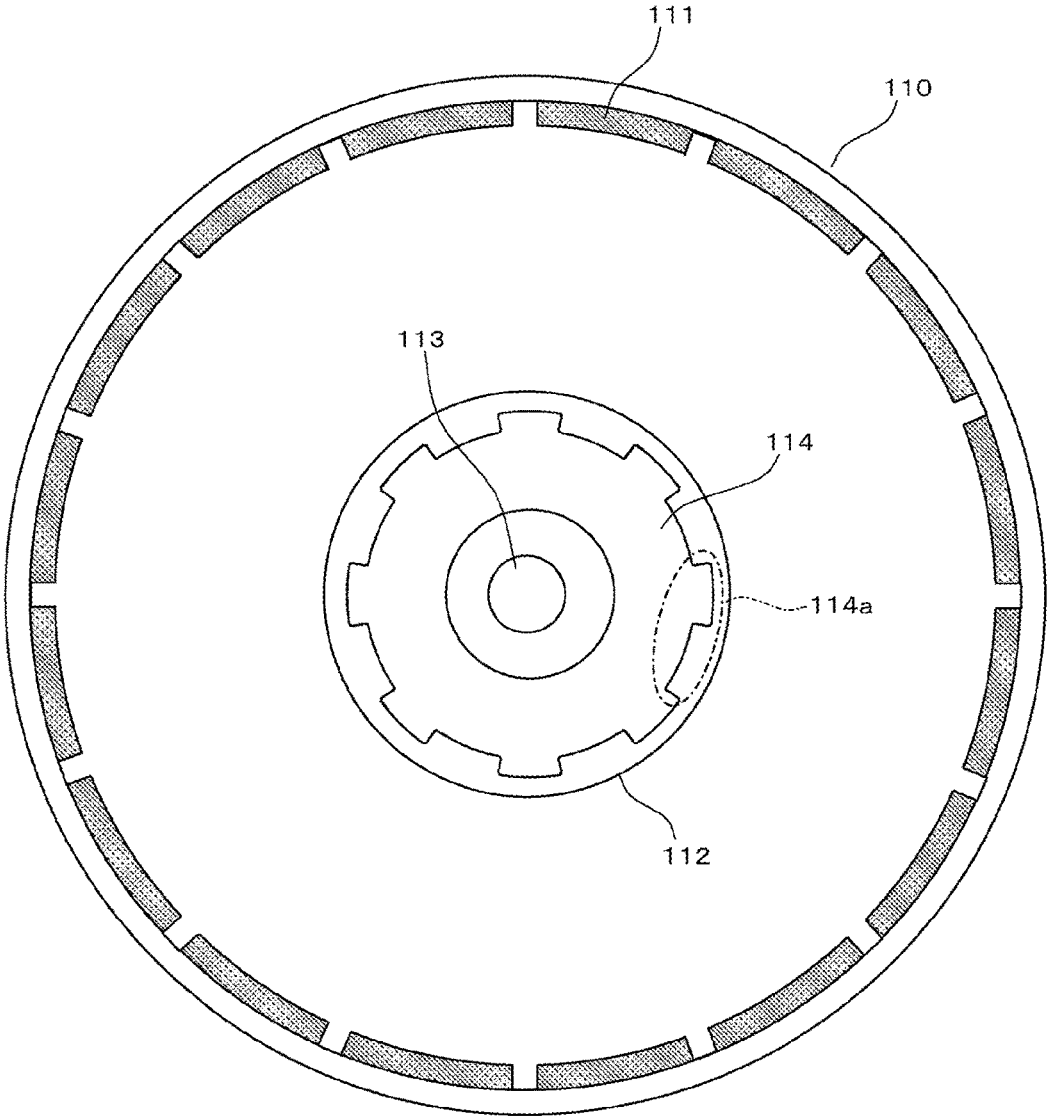
FIG. 4 is a rotor front view illustrating a structure of a rotor of a driving motor in embodiments.
Figure 5:
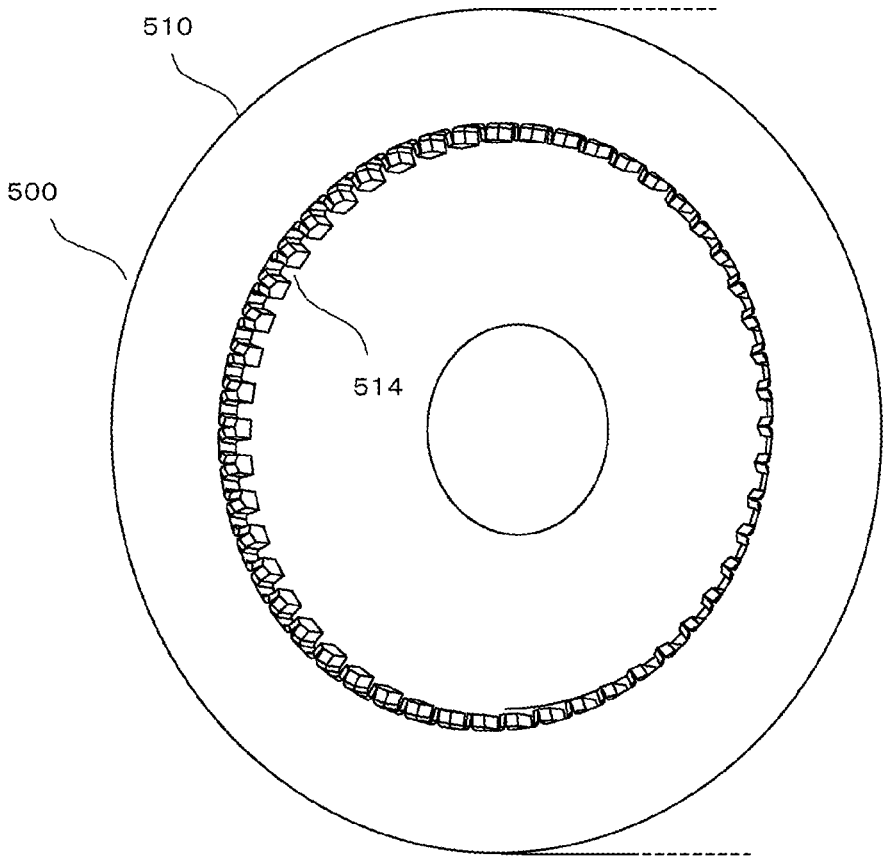
FIG. 5 is an enlarged three-dimensional view illustrating a rear of a bearing unit formed with a rack in embodiments.
Figure 6C:
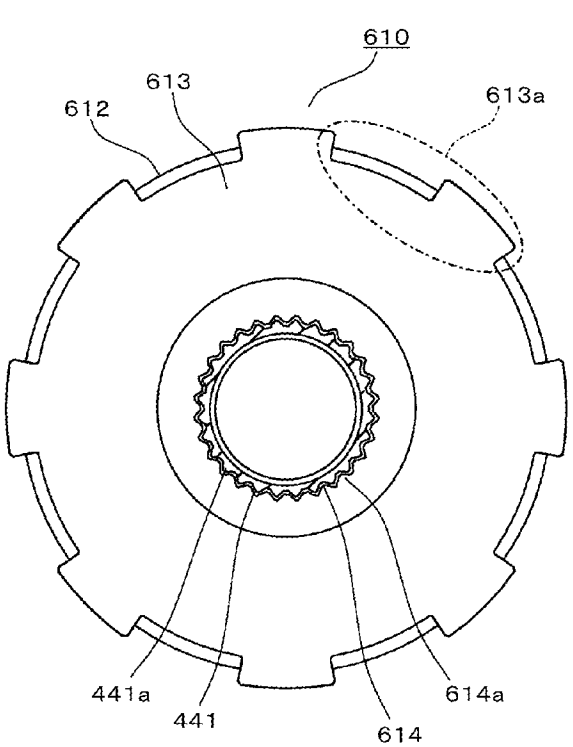
FIG. 6*c* is a third diagram illustrating a structure of a clutch body of a clutch mechanism part in embodiments.
Figure 6B:
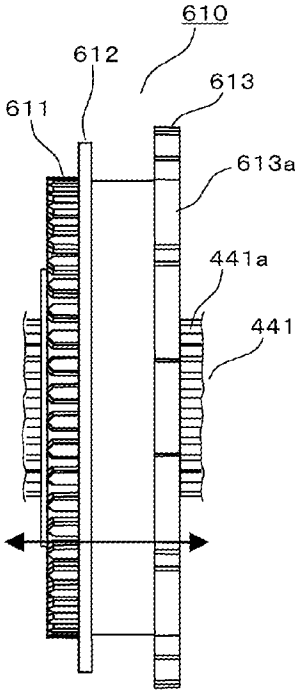
FIG. 6*b* is a second diagram illustrating a structure of a clutch body of a clutch mechanism part in embodiments.
Figure 6A:
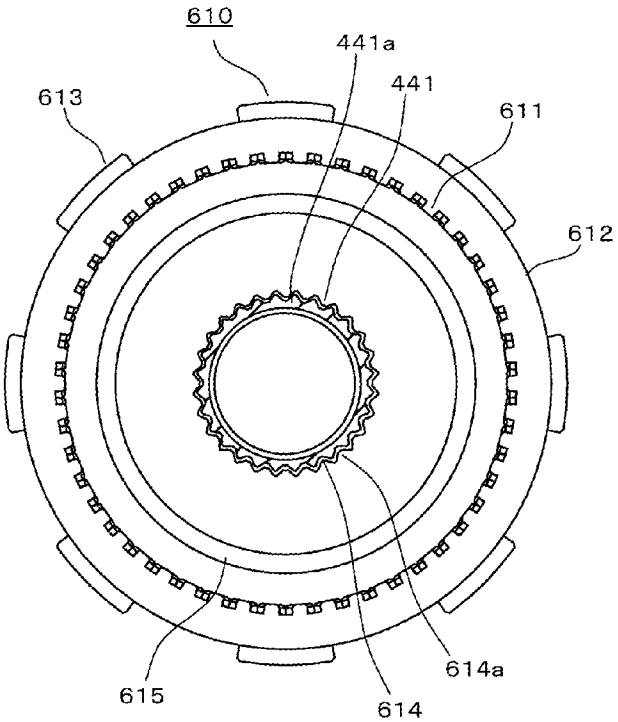
FIG. 6*a* is a diagram illustrating a structure of a clutch body of a clutch mechanism part in embodiments.

FIG. 2 and FIG. 3 are sectional views illustrating a structure of the driving unit 30. FIG. 2 shows a state of switching a driving form of the driving unit 30 to a biaxial driving form. FIG. 3 shows a state of switching a driving form of the driving unit 30 to a uniaxial driving form. FIG. 4 is a front view of a rotor 110 illustrating a structure of the rotor 110 of a driving motor 100. FIG. 5 is an enlarged three-dimensional view illustrating a rear of a bearing unit 500 formed with a rack 514. FIGS. 6*a*-6*c* are diagrams illustrating a structure of a clutch body 610 of a clutch mechanism part 600, and are respectively a front view, a right view and a rear view of the clutch body 610.

The driving unit 30 includes: the driving motor 100, a wing shaft 200, a drum shaft 300, a planetary gear mechanism 400, the bearing unit 500 and the clutch mechanism part 600. The driving motor 100 generates a torque used for driving the stirring body 24 and the drum 22. The wing shaft 200 rotates by utilizing the torque of the driving motor 100, and rotation is transmitted to the stirring body 24. The planetary gear mechanism 400 decelerates rotation of the wing shaft 200, namely rotation of the rotor 110 of the driving motor 100, and transmits rotation to the drum shaft 300. The drum shaft 300 coaxially rotates with the wing shaft 200 at a rotating speed of the decelerated planetary gear mechanism 400, and transmits rotation to the drum 22. The bearing unit 500 supports the wing shaft 200 and the drum shaft 300 in a free rotation manner. The clutch mechanism part 600 switches the driving form of the driving unit 30 between the biaxial driving form and the uniaxial driving form, wherein the biaxial driving form is a state that the stirring body 24, namely the wing shaft 200, rotates at a rotating speed the same as the rotating speed of the driving motor 100, and the drum 22, namely the drum shaft 300, rotates at the rotating speed of the decelerated planetary gear mechanism 400; and the uniaxial driving form is a state that the stirring body and the drum 22, namely the wing shaft 200, the drum shaft 300 and the planetary gear mechanism 400, integrally rotate at a rotating speed the same as that of the driving motor 100.

The driving motor 100 is an outer rotor type DC brushless motor, and includes the rotor 110 and a stator 120. The rotor 110 is formed into a cylinder with a bottom, and permanent magnets 111 are arranged on the inner circumferential surface throughout the circumference of the rotor. As shown in FIG. 4, a circular shaft sleeve part 112 is formed in the central part of the rotor 110. A shaft sleeve hole 113 used for fixing the wing shaft 200 is formed in the shaft sleeve part 112, and an annular engaged recess 114 is formed at the periphery of the shaft sleeve hole 113. Uneven parts 114*a* are configured at the periphery of the engaged recess 114 throughout the circumference.

The stator 120 is provided with a coil 121 at the periphery. The rotor 110 rotates when driving current is supplied from a motor driving part below to the coil 121 of the stator 120.

The drum shaft 300 has a hollow shape, and is internally provided with the wing shaft 200 and the planetary gear mechanism 400. The central part of the drum shaft 300 is bulged outside, and the bulged part forms a containing part of the planetary gear mechanism 400.

The planetary gear mechanism 400 includes: a sun gear 410, an annular internal gear 420 surrounding the sun gear 410, a plurality of groups of planetary gears 430 between the sun gear 410 and the internal gear 420, and a planetary gear carrier 440 which retains the planetary gears 430 in a free rotation manner.

The sun gear 410 is fixed on the wing shaft 200, and the internal gear 420 is fixed on the drum shaft 300. A group of planetary gears 430 includes a first gear and a second gear which are meshed with each other and reversely rotate. The planetary gear carrier 440 includes a gear carrier shaft 441 extending backwards. The gear carrier shaft 441 and the drum shaft 300 are coaxial, and the interior of the gear carrier shaft 441 is hollow so as to insert the wing shaft 200.

The rear end of the wing shaft 200 protrudes backwards from the gear carrier shaft 441 and is fixed at the shaft sleeve hole 113 in the rotor 110.

A cylindrical bearing part 510 is configured in the central part of the bearing unit 500. A rolling shaft 511 and a rolling shaft 512 are configured at the front and rear parts inside the bearing part 510, and a mechanical seal 513 is configured at the front end part. The peripheral surface of the drum shaft 300 is supported by the rolling shafts 511 and 512 and smoothly rotates inside the cylindrical bearing part 510. In addition, water is prevented from intruding between the bearing part 510 and the drum shaft 300 through the mechanical seal 513. As shown in FIG. 5, racks 514 are formed on the inner surface throughout the circumference at the rear end part of the bearing part 510.

A fixed flange part 520 is formed around the bearing part 510 in the bearing unit 500. A mounting shaft sleeve 521 is formed in the lower end part of the fixed flange part 520.

The bearing unit 500 is fixed behind the outer tank 20 at the fixed flange part 520 by fastening screws and other fixing methods. The wing shaft 200 and the drum shaft 300 face the interior of the outer tank 20 in a state that the driving unit 30 is mounted in the outer tank 20. The drum 22 is fixed on the drum shaft 300, and the stirring body 24 is fixed on the wing shaft 200.

The clutch mechanism part 600 includes: the clutch body 610, a clutch spring 620, a clutch lever 630, a lever supporting part 640, a clutch driving apparatus 650, a joining rod 660 and a mounting plate 670.

As shown in FIGS. 6*a*-6*c*, the clutch body 610 roughly has a disc shape. An annular rack 611 is formed in the peripheral surface at the front end part of the clutch body 610. The rack 611 is formed in a manner of engaging with the rack 514 on the bearing unit 500. In addition, a flange part 612 is formed in the rear of the rack 611 on the peripheral surface of the clutch body 610. Further, an annular engaging flange part 613 is formed in the rear end part of the clutch body 610. The engaging flange part 613 has the same shape as that of the engaged recess 114 of the rotor 110, and is provided with uneven parts 613*a* at the periphery throughout the circumference. When the engaging flange part 613 is inserted into the engaged recess 114, the uneven parts 613*a* and 114*a* are engaged with one another.

The gear carrier shaft 441 is inserted into a shaft hole 614 of the clutch body 610. A rack 614*a* formed in the inner circumferential surface of the shaft hole 614 is engaged with the rack 441*a* formed in the outer circumferential surface of the gear carrier shaft 441. Therefore, the clutch body 610 is in a state that movement in the front and rear directions relative to the gear carrier shaft 441 is allowed and rotation in the circumferential direction is limited.

An annular containing groove 615 is formed in the outer side of the shaft hole 614 in the clutch body 610, and the clutch spring 620 is contained in the containing groove 615. One end of the clutch spring 620 is connected with the rear end part of the bearing part 510, and the other end of the clutch spring 620 is connected with the bottom surface of the containing groove 615.

A pressing part 631 in contact with the rear of the flange part 612 of the clutch body 610 and capable of pushing the flange part 612 forwards is formed on the upper end part of the clutch lever 630. The clutch lever 630 is supported by a supporting shaft 641 configured on the lever supporting part 640 in a free rotation manner. A mounting shaft 632 is formed on the lower end part of the clutch lever 630.

The clutch driving apparatus 650 is configured below the clutch lever 630. The clutch driving apparatus 650 includes a torque motor 651 and a disc-shaped cam 652 which rotates around a horizontal axis by virtue of the torque of the torque motor 651. A camshaft 653 is arranged at the periphery on the cam 652. A rotating center of the cam 652 is consistent with a center of the mounting shaft 632 of the clutch lever 630 in the front and rear directions.

The joining rod 660 extends up and down and connects the clutch lever 630 and the cam 652. The upper end part of the joining rod 660 is mounted on the mounting shaft 632 of the clutch lever 630, and the lower end part of the joining rod 660 is mounted on the camshaft 653 of the cam 652. A spring 661 is integrally formed in a middle position of the joining rod 660 and is an extension spring.

The lever supporting part 640 and the clutch driving apparatus 650 are fixed on the mounting plate 670 by fastening screws and other fixing methods. The mounting plate 670 is fixed on a mounting shaft sleeve 521 of the bearing unit 500 by screws.

As shown in FIG. 2, the cam 652 rotates by utilizing the torque motor 651 so as to enable the camshaft 653 to be positioned at the lowest part under the condition that the driving form of the driving unit 30 is switched from the uniaxial driving form to the biaxial driving form. Along with rotation of the cam 652, the lower end part of the clutch lever 630 is pulled to be lower part by the joining rod 660. The clutch lever 630 rotates forwards by taking the supporting shaft 641 as a center, and the pressing part 631 pushes the clutch body 610 forwards. The clutch body 610 moves forwards against the elastic force of the clutch spring 620, and the rack 611 of the clutch body 610 is engaged with the rack 514 of the bearing unit 500.

The rack 611 reaches a position where the rack 611 is engaged with the rack 514 when the camshaft 653 of the clutch body 610 is moved to a middle specified position. Then, the spring 661 of the joining rod 660 is in a natural length state. Since the clutch body 610 is not moved to a position closer to the engaging position, as shown in FIG. 2, the spring 661 extends to the lower part when the camshaft 653 is moved from the specified position to the lowest position. In this way, since the clutch lever 630 is pulled by the spring 661 in a forward rotating manner, pressing force is applied to the clutch body 610 positioned at the engaging position from the pressing part 631. Then, the rack 611 can be tightly engaged on the rack 514.

When the rack 611 is engaged with the rack 514, since rotation of the clutch body 610 in the circumferential direction relative to the bearing unit 500 is limited and the clutch body is in a non-rotatable state, the gear carrier shaft 441 of the planetary gear mechanism 400, namely the planetary gear carrier 440, is in a state of being fixed in a non-rotatable manner. In such a state, when the rotor 110 rotates, the wing shaft 200 rotates at a rotating speed equal to the rotating speed of the rotor 110, and the stirring body 24 connected with the wing shaft 200 also rotates at a rotating speed equal to the rotating speed of the rotor 110. Along with rotation of the wing shaft 200, the sun gear 410 rotates in the planetary gear mechanism 400. As mentioned above, since the planetary gear carrier 440 is in a fixed state, the first gears and second gears of the planetary gears 430 respectively rotate with the sun gear 410 in the same direction and a reverse direction, and the internal gear 420 rotates with the sun gear 410 in the same direction. Therefore, the drum shaft 300 fixed on the internal gear 420 is in the same direction as the wing shaft 200, and rotates at a rotating speed lower than that of the wing shaft 200, and the drum 22 fixed on the drum shaft 300 rotates with the stirring body 24 in the same direction at a rotating speed lower than that of the stirring body 24. In other words, the stirring body 24 rotates with the drum 22 in the same direction at a rotating speed higher than that of the drum 22.

On the other hand, as shown in FIG. 3, the cam 652 is rotated by utilizing the torque motor 651 so as to enable the camshaft 653 to be positioned at the uppermost part under the condition that the driving form of the driving unit 30 is switched from the biaxial driving form to the uniaxial driving form. When the cam 652 rotates and the camshaft 653 moves upwards, the spring 661 contracts first. When the spring 661 returns to natural length and then is moved along with the camshaft 653, the joining rod 660 moves upwards, and the lower end part of the clutch lever 630 is pushed by the joining rod 660 to move upwards. The clutch lever 630 rotates backwards by taking the supporting shaft 641 as a center, and the pressing part 631 is separated from the flange part 612 of the clutch body 610. The clutch body 610 moves backwards by utilizing the elastic force of the clutch spring 620, and the engaging flange part 613 of the clutch body 610 is engaged with the engaged recess 114 of the rotor 110.

When the engaging flange part 613 is engaged with the engaged recess 114, rotation to the circumferential direction of the clutch body 610 relative to the rotor 110 is limited, and the clutch body 610 and the rotor 110 are in a rotatable state together. In such a state, when the rotor 110 rotates, the wing shaft 200 and the clutch body 610 rotate at a rotating speed equal to the rotating speed of the rotor 110. Then, in the planetary gear mechanism 400, the sun gear 410 and the planetary gear carrier 440 rotate at a rotating speed equal to that of the rotor 110. Thus, the internal gear 420 rotates at a rotating speed equal to that of the sun gear 410 and the planetary gear carrier 440, and the drum shaft 300 fixed on the internal gear 420 rotates at a rotating speed equal to that of the rotor 110, that is, in the driving unit 30, the wing shaft 200, the planetary gear mechanism 400 and the drum shaft 300 are integrally rotate. Therefore, the drum 22 and the stirring body 24 are integrally rotate.

The driving form of the driving unit 30 is switched to the biaxial driving form in the washing process and the rinsing process. In the biaxial driving form, when the driving motor 100 works, the drum 22 and the stirring body 24 alternately rotate from left to right at a rotating speed through which the centrifugal force acting on the washings is smaller than the gravity and at a rotating speed higher than that of the drum 22 respectively. The washings in the drum 22 are lifted up and dropped down by the baffles 23 and are beaten on the inner circumferential surface of the drum 22. In addition, the washings are in contact with the rotating stirring body 24 at the rear of the drum 22, and the washings are rubbed or stirred. Therefore, the washings are washed or rinsed.

In this way, since not only mechanical force produced by rotation of the drum 22 but also mechanical force produced by the stirring body 24 can be applied to the washings during washing and rinsing, and therefore, improvement of the cleaning performance can be expected.

The driving form of the driving unit 30 is switched to the uniaxial driving form in an intermediate dewatering process and a final dewatering process. In the uniaxial driving form, the drum 22 and the stirring body 24 integrally rotate at a rotating speed through which the centrifugal force acting on the washings is far larger than the gravity when the driving motor 100 works. Due to the action of the centrifugal force, the washings are pressed on the inner circumferential surface of the drum 22 for dewatering.

In this way, since the drum 22 and the stirring body 24 integrally rotate during dewatering, the washings attached to the drum 22 can be well dewatered without the need of stirring the washings by the stirring body 24.

Moreover, the washings are compressed between the door 12 on the front surface of the drum 22 and the stirring body 24 on the rear surface of the drum 22 under the condition that lots of dried washings are contained in the drum 22; and the stirring body 24 is in a pressed state due to the washings. In addition, the washings and the stirring body 24 in a dried state have a larger friction coefficient than in a wetted state. Therefore, when the drum 22 and the stirring body 24 respectively rotate under the condition that the stirring body 24 is in the pressed state due to the dried washings, a large load produced by the washings is applied to the stirring body 24, so that the driving motor 100 can be locked.

Therefore, in the present embodiment, in order to reduce the friction force produced between the stirring body 24 and the washings in contact with the stirring body 24, the water supply mechanism part for splashing water is configured on the surface of the stirring body 24.

Embodiment 1

In the present embodiment, the water supply mechanism part is configured on the rear surface of the drum 22. The water supply mechanism part is contained in the retainer unit 25.

Structures of the stirring body 24 and the retainer unit 25 which includes the water supply mechanism part are described below in detail.

Figure 7:
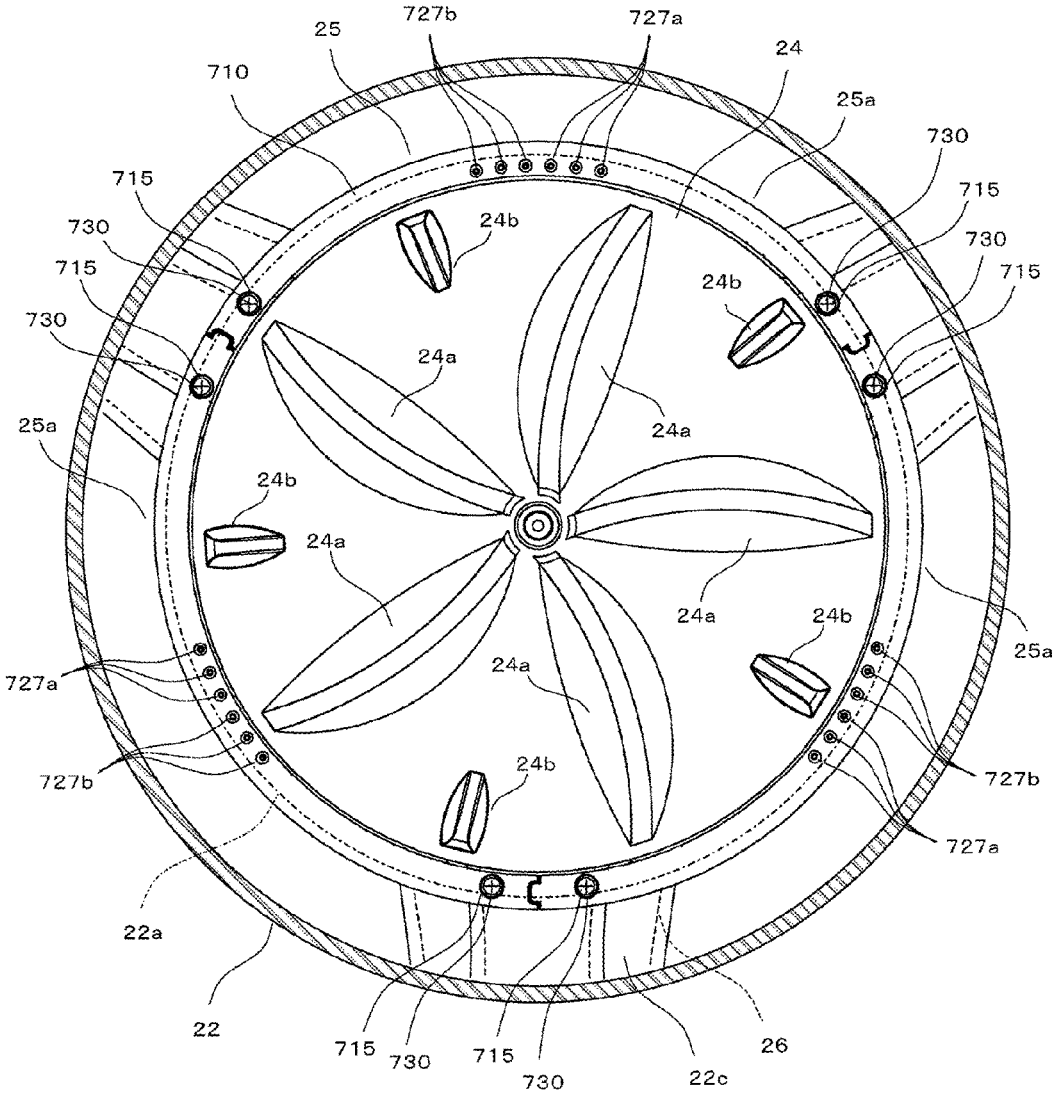
FIG. 7 is a front sectional view illustrating a drum of a state in which a stirring body and a retainer unit are installed in embodiment 1.
Figure 8:
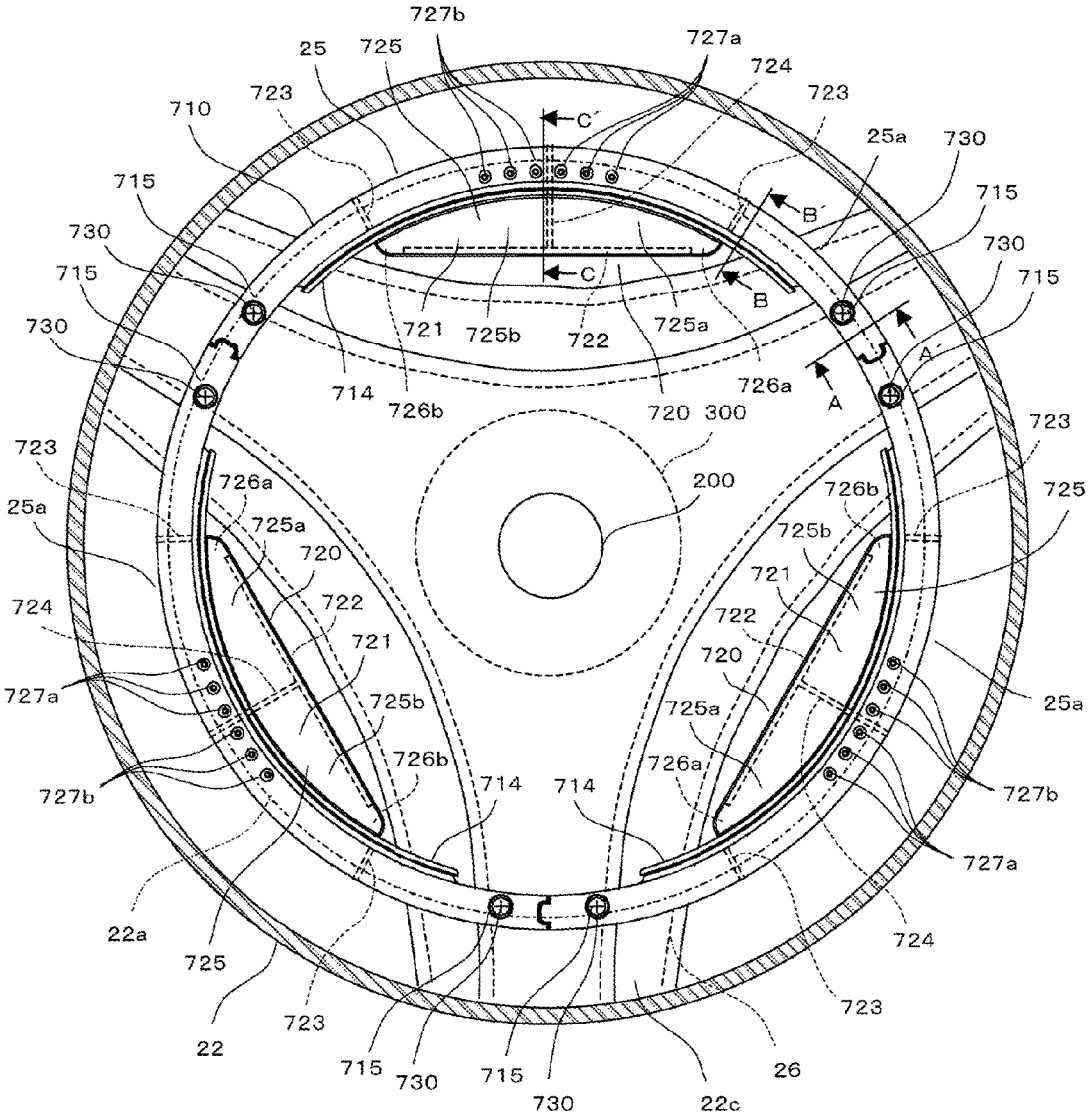
FIG. 8 is a front sectional view illustrating a drum of a state in which a retainer unit is installed without a stirring body in embodiment 1.
Figure 9B:
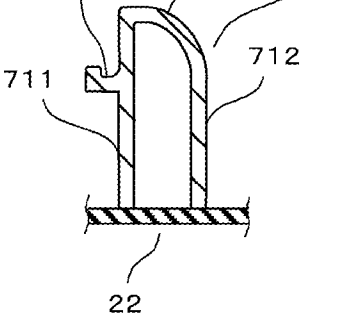
FIG. 9*b* is a B-B' sectional view of FIG. 8.
Figure 9A:
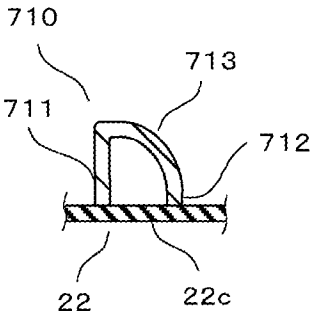
FIG. 9*a* is an A-A' sectional view of FIG. 8.
Figure 9C:
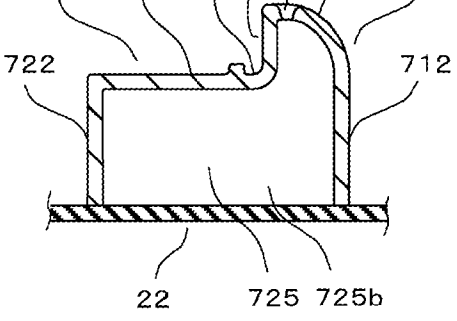
FIG. 9*c* is a C-C' section view of FIG. 8.
Figure 10:
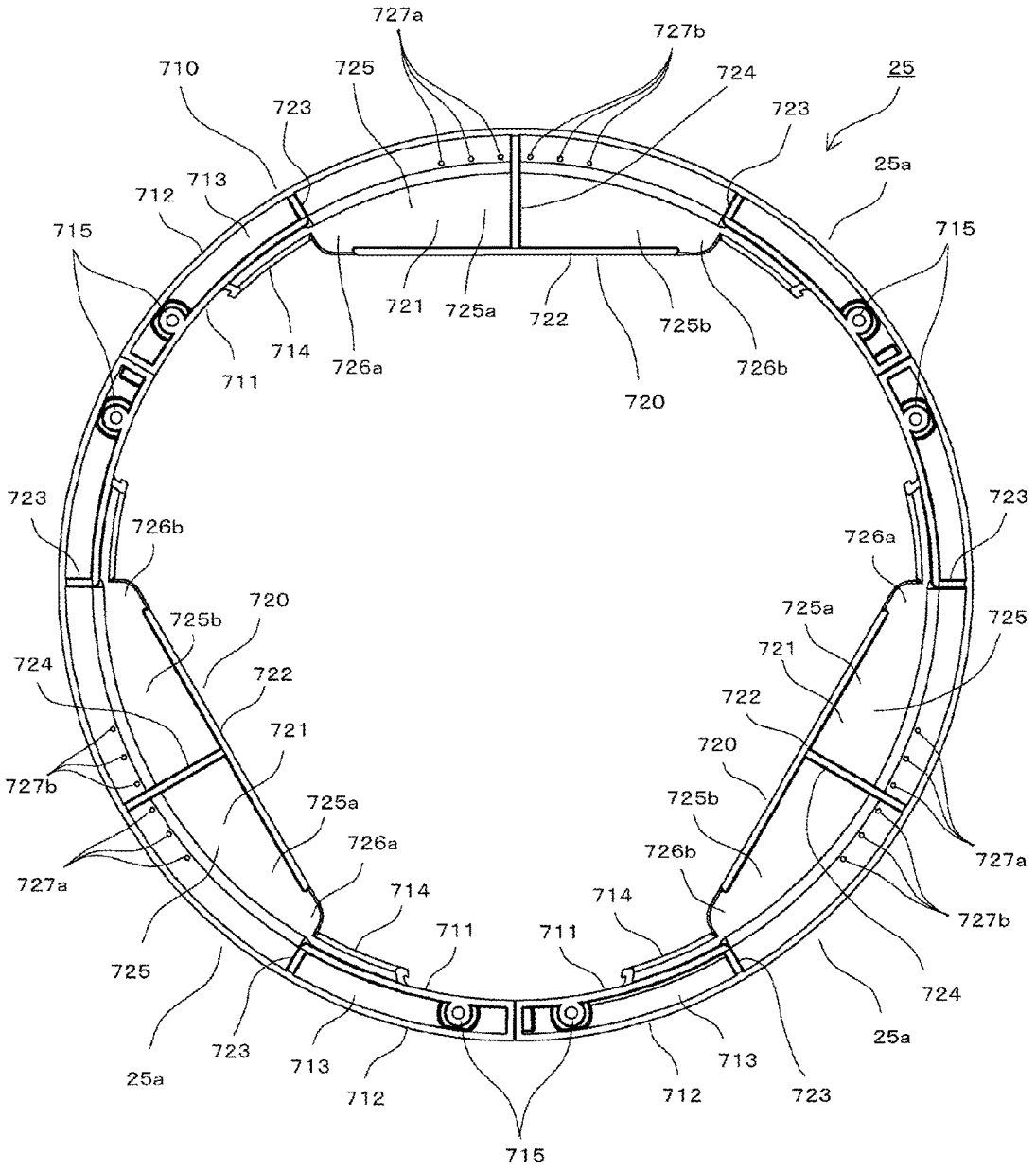
FIG. 10 is a rear view illustrating a retainer unit in embodiment 1.
Figure 11:
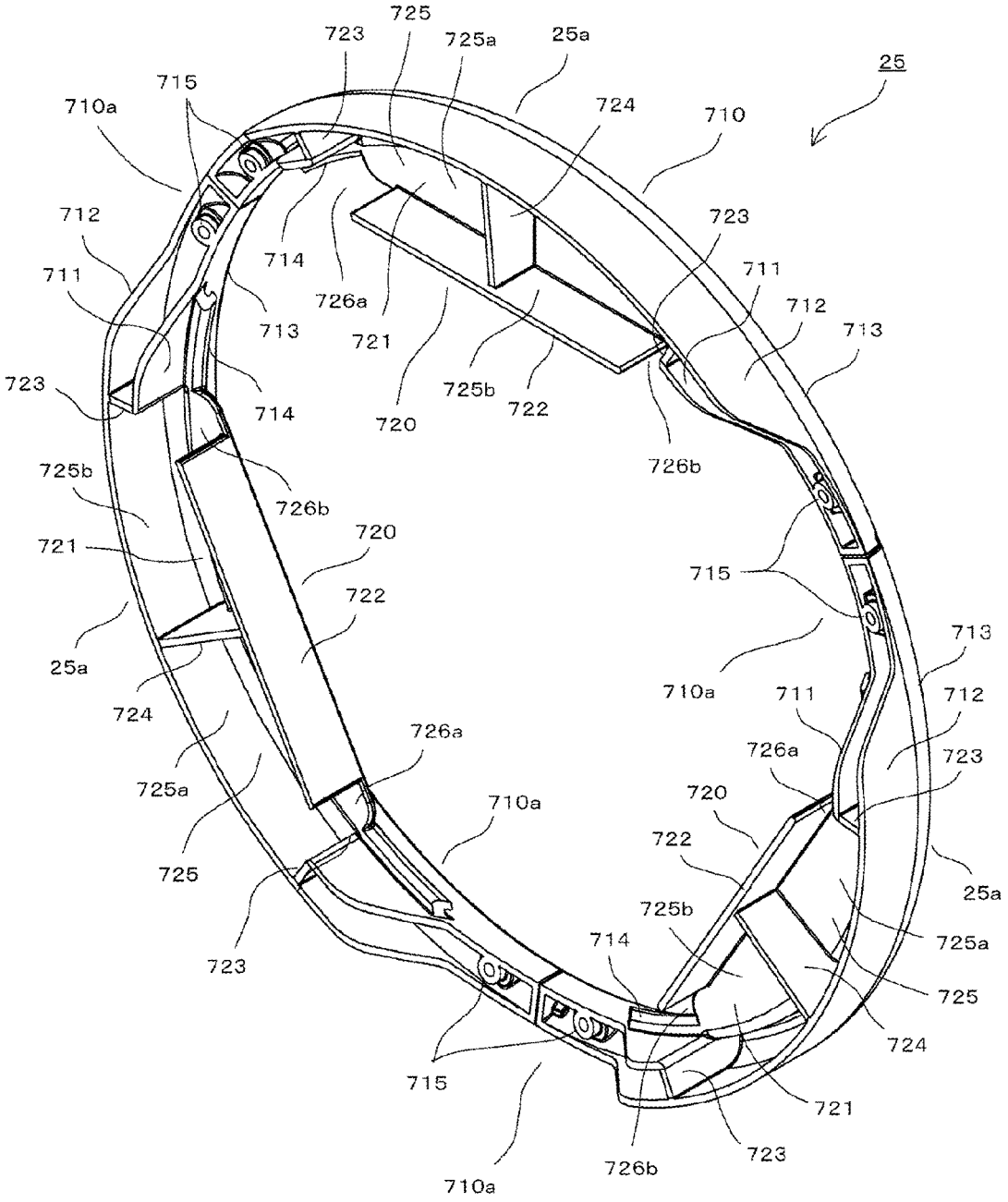
FIG. 11 is a rear three-dimensional diagram illustrating a retainer unit in embodiment 1.

FIG. 7 to FIG. 10 are diagrams illustrating structures of the stirring body 24 and the retainer unit 25 in the present embodiment. FIG. 7 is a front sectional view illustrating the drum 22 in a state in which the stirring body 24 and the retainer unit 25 are installed. FIG. 8 is a front sectional view illustrating the drum 22 in a state in which the stirring body 24 is removed and the retainer unit 25 is installed. FIGS. 9*a*, 9*b* and 9*c* are respectively an A-A' sectional view, a B-B' sectional view and a C-C' sectional view of FIG. 8. FIG. 10 and FIG. 11 are respectively a rear view and a rear three-dimensional diagram illustrating the retainer unit 25.

A plurality of main blades 24*a* extending from the central part radially are formed in the surface of the stirring body 24. In addition, an auxiliary blade 24*b* is formed between every two main blades 24*a* of the periphery on the surface of the stirring body 24. The main blades 24*a* have a shape of protruding and bending to a left-hand rotation direction in a surface inside direction perpendicular to the front and rear directions. The auxiliary blades 24*b* are smaller and lower than the main blades 24*a*. The main blades 24*a* are equivalent to the protruding part of the present disclosure.

The retainer unit 25 includes a retainer 710 which is annular and surrounds the stirring body 24, and three water storage shells 720 formed into a whole with the retainer 710 in a manner of using part of the retainer 710. The retainer unit 25 is divided into three annular components 25*a* of the same shape.

In the present embodiment, the stirring body 24 is set into a size as large as possible from a size through which the stirring body can be put from an opening part 22*a* of the drum 22. Therefore, the outer diameter of the retainer 710 is set to be larger than the opening part 22*a* of the drum 22 indicated by dash-dotted circles in FIG. 7 and FIG. 8. Thus, the retainer unit 25 cannot be put into the drum 22 from the opening part 22*a* in a completed state. Therefore, the retainer unit 25 is put into the drum 22 from the opening part 22*a* in a state of being divided into three annular components, and assembled in the drum 22.

The retainer 710 includes an inner peripheral wall 711 and an outer peripheral wall 712, as well as an upper surface wall 713 connecting the inner peripheral wall 711 and the outer peripheral wall 712, and the lower surface is opened. The lower part of the inner peripheral wall 711 is cut out on part of the retainer 710 which forms the water storage shells 720. The upper surface wall 713 is set as a curved inclined surface recessed outwards, so that the washings are difficult to damage when the upper surface wall 713 is in contact with the washings.

A roughly Y-shaped drum mounting flange 26 provided with arms extending towards three directions is mounted on the inner side of the rear surface of the drum 22, and the drum shaft 300 is fixed on the drum mounting flange 26. In order to reduce the protrusion amount towards the inner side of the drum mounting flange 26, a flange mounting part 22*c* mounted with the drum mounting flange 26 on the rear surface of the drum 22 is bulged towards the surface side. In order to avoid the flange mounting part 22*c*, the inner peripheral wall 711, the outer peripheral wall 712 and the bulge shape of the flange mounting part 22*c* are cut out in a matched manner on a corresponding part 710*a* corresponding to the flange mounting part 22*c* in the retainer 710 (with reference to FIG. 11).

Except the flange mounting part 22*c* and an interfered part, a flange part 714 is almost formed across the whole periphery on the inner side of the retainer 710. The flange part 714 is opposite to interior of the periphery of the stirring body 24. In addition, screw holes 715 are formed in positions at two ends of each annular component 25*a* on the retainer 710. Screws 730 penetrate through each screw hole 715, and each annular component 25*a* is mounted onto the rear surface of the drum 22 by using the screws 730, so that the retainer unit 25 is fixed on the rear surface of the drum 22 in an assembled state.

The lower surface of the retainer 710 is in contact with the rear surface of the drum 22. Thus, since a gap formed between the stirring body 24 and the rear surface of the drum 22 is buried by the retainer 710, the washings can be prevented from being damaged due to friction between the stirring body 24 and the drum 22.

The water storage shells 720 are arranged on the rear surface of the drum 22 in a position opposite to the periphery of the stirring body 24 and a position far away from the flange mounting part 22*c*. The water storage shells 720 include: part of the retainer 710, an upper surface plate 721 protruding towards the inner side than the flange part 714, a front surface plate 722 sagging from the front end part of the upper surface plate 721, a transverse separating plate 723 for separating the water storage shells 720 and the retainer 710, and a central separating plate 724 for separating the interior of the water storage shells 720 into two chambers.

The lower surfaces of the water storage shells 720 are opened. The lower surfaces of the water storage shells 720 are closed on the rear surface of the drum 22 when the retainer unit 25 is mounted on the rear surface of the drum 22, so that water can be stored in a space formed between the water storage shells 720 and the rear surface of the drum 22. In this way, a water storage part 725 is formed on the water storage shells 720 and the rear surface of the drum 22. The water storage part 725 is divided into a first water storage part 725*a* and a second water storage part 725*b* by the central separating plate 724.

A gap is formed between the front surface plate 722 and the transverse separating plate 723 on the side of the first water storage part 725*a* and becomes a first intake port 726*a* used for obtaining water in the outer tank 20 flowing towards the first water storage part 725*a*. In addition, a gap is formed between the front surface plate 722 and the transverse separating plate 723 on the side of the second water storage part 725*b* and becomes a second intake port 726*b* used for obtaining the water in the outer tank 20 flowing towards the second water storage part 725*b*. The first intake port 726*a* is opened in the advancing direction side when the drum 22 rotates to the right, and the second intake port 726*b* is opened in the advancing direction side when the drum 22 rotates to the left. Thus, the water in the first water storage part 725*a* is easy to obtain when the drum 22 rotates to the right, and the water in the second water storage part 725*b* is easy to obtain when the drum 22 rotates to the left. The first intake port 726*a* and the second intake port 726*b* are equivalent to the intake port of the present disclosure.

As mentioned above, the water storage shells 720 are configured in an area of the flange mounting part 22*c* far away from the rear surface of the drum 22, that is, an area recessed backwards relative to the flange mounting part 22*c*. Therefore, since the height of the water storage part 725 can be increased, the internal volume of the water storage part 725 can be enlarged, and the water storage capacity can be improved.

A plurality of first outflow ports 727*a* configured to enable water to flow out of the first water storage part 725*a* and second outflow ports 727*b* configured to enable the water to flow out of the second water storage part 725*b* are formed on the side of the first water storage part 725*a* and the side of the second water storage part 725*b* by taking the central separating plate 724 as a boundary on the upper surface wall 713 of the retainer 710 forming the upper surface of the water storage shells 720 together with the upper surface plate 721. The first outflow ports 727*a* and the second outflow ports 727*b* are equivalent to the outflow ports of the present disclosure.

The first water storage part 725*a*, the second water storage part 725*b*, the first intake port 726*a*, the second intake port 726*b*, the first outflow ports 727*a* and the second outflow ports 727*b* form the water supply mechanism part contained in the retainer unit 25.

In the drum washing machine 1 of the present embodiment, the drum 22 and the stirring body 24 are enabled to slowly and integrally rotate through the uniaxial driving form in a state that water is stored in the outer tank 20 before the drum 22 and the stirring body 24 respectively rotate through the biaxial driving form in a cleaning process, so that the wetting process for wetting the surface of the stirring body 24 by using the water provided by the water storage part 725 is performed. The drum 22 and the stirring body 24 alternately rotate from left to right in the wetting process.

Figure 12:
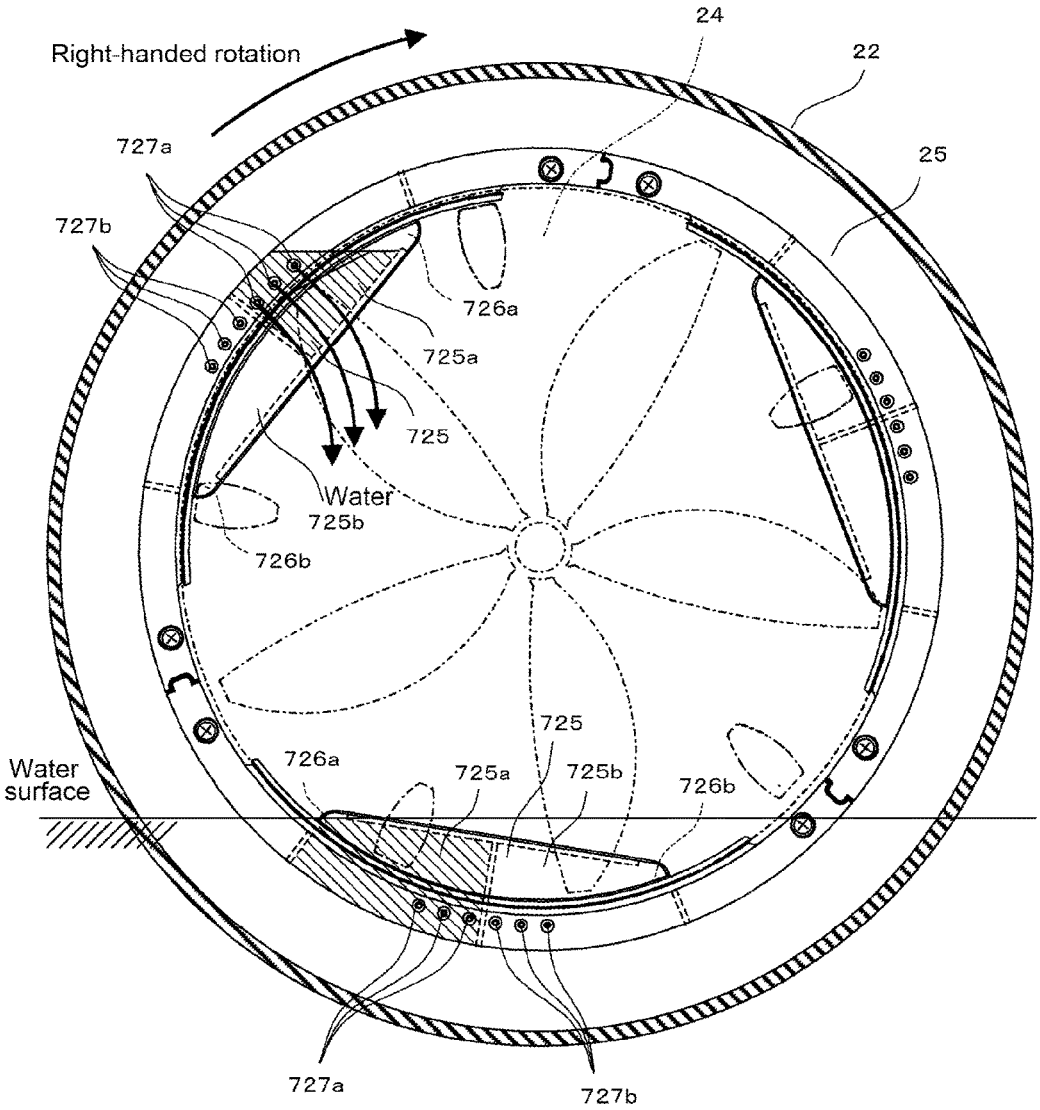
FIG. 12 is a diagram schematically illustrating a shape of washings wetted by a wetting process in embodiment 1.

FIG. 12 is a diagram schematically illustrating a shape of washings wetted by the wetting process. In FIG. 12, the condition that the drum 22 performs right-hand rotation is illustrated, and the shape of the drum 22 subjected to left-hand rotation is the same as the condition of right-hand rotation. In FIG. 12, for convenience, the stirring body 24 is described in a transparent state in a dash-dotted manner.

The condition that the drum 22 performs right-hand rotation is mainly that a function of enabling the first water storage part 725*a* to splash water to the surface of the stirring body 24 is realized, that is, as shown in FIG. 11, when the first water storage part 725*a* is immersed into the water stored in the outer tank 20, the water flows into the first water storage part 725*a* from the first intake port 726*a* so as to be stored in the first water storage part 725*a*. When the first water storage part 725*a* is lifted up from the water, the water stored in the first water storage part 725*a* flows out of the first outflow ports 727*a* and is splashed to the surface of the stirring body 24.

Similarly, the condition that the drum 22 performs left-hand rotation is mainly that a function of enabling the second water storage part 725*b* to splash water to the surface of the stirring body 24 is realized, that is, when the second water storage part 725*b* is immersed into the water stored in the outer tank 20, the water is stored in the second water storage part 725*b* through the second intake port 726*b*. Then, the water stored in the second water storage part 725*b* flows out of the second outflow ports 727*b* at an upper position and is splashed to the surface of the stirring body 24

In this way, the stirring body 24 and the washings in contact with the stirring body 24 are wetted, and the friction force between the stirring body and the washings is reduced.

In addition, according to the condition that the drum 22 performs right-hand rotation, since the second intake port 726*b* faces one side opposite to the rotating direction of the drum 22 in the second water storage part 725*b*, the water is difficult to be stored. In addition, the water stored in the second water storage part 725*b* flows out of the second intake port 726*b* when the second water storage part 725*b* is lifted up. Therefore, the second water storage part 725*b* actually does not perform the function of splashing water to the surface of the stirring body 24. Similarly, according to the condition that the drum 22 performs left-hand rotation, the first water storage part 725*a* actually does not perform the function of splashing water to the surface of the stirring body 24.

In addition to the wetting process, for example, water is splashed to a display surface of the stirring body 24 through the water supply mechanism part when the drum 22 rotates during cleaning and rinsing. In this way, the friction force between the stirring body 24 and the washings can be kept low when the drum 22 rotates in a state that the water is stored in the outer tank 20.

In the above example, a structure that the lower surfaces of the water storage shells 720 are opened may be adopted, but a structure that the lower surfaces of the water storage shells 720 are closed by lower surface plates also can be adopted. In this case, the water storage part 725 is only composed of the water storage shells 720.

Further, in the above examples, the water storage part 725 configured on the rear surface of the drum 22, that is, the water supply mechanism part, and the retainer unit 25 may be formed into a whole, but the water storage part 725 can be formed independently from the retainer unit 25.

Further, in the above examples, although a gap exists between the water storage part 725 and the flange mounting part 22*c* on the rear surface of the drum 22, the water storage part 725 can be enlarged as long as the water storage part 725 is not in contact with the flange mounting part 22*c*.

Effects of Embodiment 1

According to the present embodiment, the friction force between the stirring body 24 and the washings can be reduced by splashing water to the surface of the stirring body 24, wetting the stirring body 24 and stirring the washings in contact with the stirring body 24. Therefore, a load applied to the stirring body 24 due to contact with the washings can be reduced, and the driving motor 100 can be prevented from being locked. In addition, cloth damage caused by intense friction between the washings and the stirring body 24 can be avoided.

In addition, according to the present embodiment, the water stored in the outer tank 20 can be drawn up through the water storage part 725 and splashed to the surface of the stirring body 24, and the surface of the stirring body 24 and the like can be wetted by utilizing the water in the outer tank 20.

Further, in the present embodiment, since the water storage part 725 is configured on the rear surface of the drum 22, the water in the outer tank 20 can be drawn up by utilizing rotation of the drum 22, so the water in the outer tank 20 can be easily utilized.

Further, in the present embodiment, the water storage part 725 is divided into the first water storage part 725*a* and the second water storage part 725*b*. Then, the first intake port 726*a* for obtaining water in the first water storage part 725*a* is formed in a manner of opening towards one side of the advancing direction when the drum 22 performs right-hand rotation, and the second intake port 726*b* for obtaining water in the second water storage part 725*b* is formed in a manner of opening towards one side of the advancing direction when the drum 22 performs left-hand rotation. Therefore, when the drum 22 performs right-hand rotation, the water easily flows into the first water storage part 725*a* and can be fully stored in the first water storage part 725*a*; and when the drum 22 performs right-hand rotation, the water easily flows into the second water storage part 725*b* and can be fully stored in the second water storage part 725*b*. Thus, the water is efficiently drawn up by virtue of the first water storage part 725*a* and the second water storage part 725*b* along with the left-hand/right-hand rotation of the drum 22, so that the stirring body 24 can be wetted.

Change Example 1 of Embodiment 1

Figure 13A:
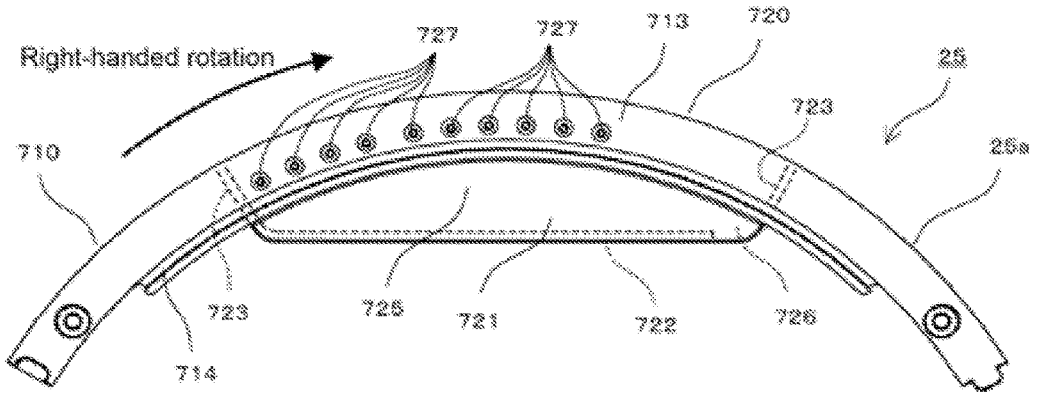
FIG. 13*a* is a diagram illustrating a structure of a retainer in a change example 1 of embodiment 1.
Figure 13B:
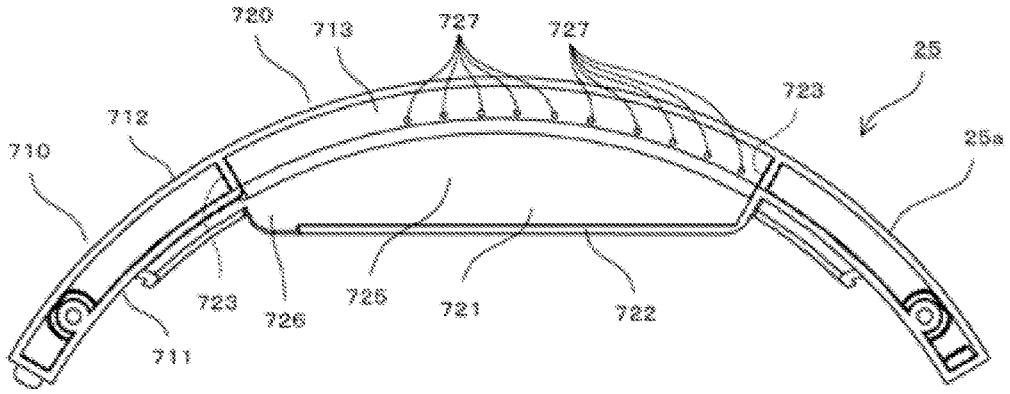
FIG. 13*b* is a second diagram illustrating a structure of a retainer in a change example 1 of embodiment 1.

FIGS. 13*a* and 13*b* are diagrams illustrating a structure of the retainer unit 25 in the present change example. FIG. 13*a* is a front view illustrating annular components 25*a* forming the retainer unit 25, and FIG. 13*b* is a rear view illustrating the annular components 25*a*.

In the above embodiment 1, the water storage part 725 is divided into the first water storage part 725*a* and the second water storage part 725*b* by utilizing the central separating plate 724 of the water storage shells 720. Accordingly, in the present change example, the central separating plate 724 is not configured, and the water storage part 725 is not divided into two parts. Therefore, the intake port 726 for obtaining the water in the water storage part 725 is formed in the water storage shells in a manner of forming the end part of the front side opening towards one side of the advancing direction during right-hand rotation at the end part as the front side when the drum 22 performs right-hand rotation. The front surface plate 722 is connected with the transverse separating plate 723 at the end part as the rear side, and the intake port 726 is not formed. The plurality of outflow ports 727 are formed as an end part close to the rear side on the upper surface wall 713 of the retainer 710.

The water storage part 725 in the present change example performs the function of splashing water to the surface of the stirring body 24 when the drum 22 performs right-hand rotation.

Figure 14:
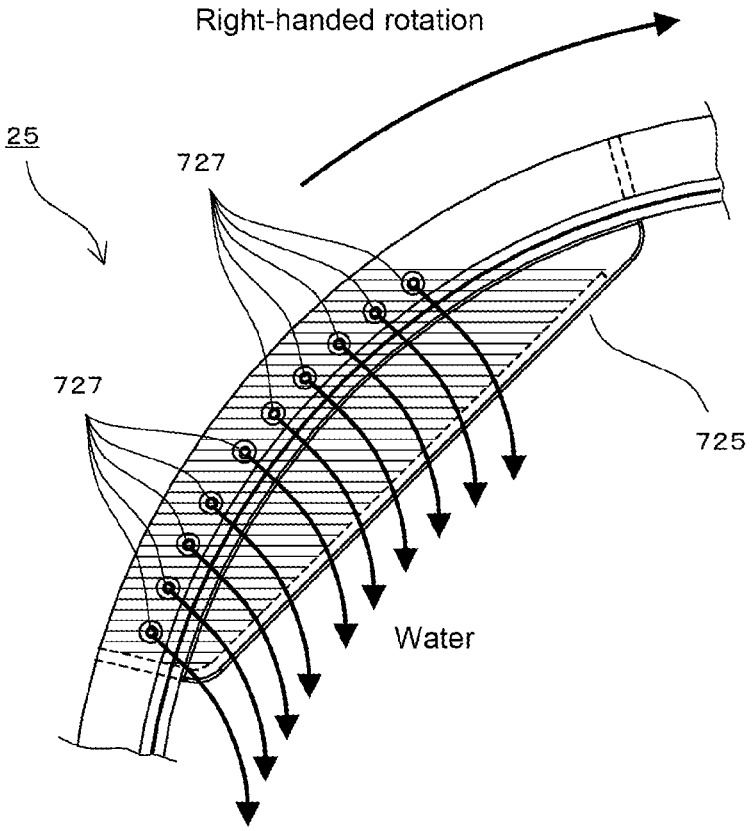
FIG. 14 is a diagram schematically illustrating an outflow shape of water stored in a water storage part in a change example 1 of embodiment 1.

FIG. 14 is a diagram schematically illustrating an outflow shape of the water stored in the water storage part 725.

In the present change example, the drum 22 only performs right-hand rotation in the wetting process. As shown in FIG. 14, water stored in the water storage part 725 soaked in the water in the outer tank 20 flows out of the outflow port 727 when the water storage part 725 moves upwards along with rotation of the drum 22. The stirring body 24 and the washings in contact with the stirring body 24 are wetted by the water flowing out.

In addition, in order to avoid the washings from twining, sometimes the drum 22 can perform left-hand rotation.

According to the composition of the present change example, since the amount of the water drawn up from the water storage part 725 each time can be increased, the amount of water splashed to the stirring body 24 through rotation of the drum 22 can be increased.

In addition, the intake port 726 can be formed in a manner of opening towards the side of the advancing direction during left-hand rotation at the end part as the front side when the drum 22 performs left-hand rotation on the water storage shells 720. In this case, the drum 22 only performs left-hand rotation in the wetting process.

Change Example 2 of Embodiment 1

Figure 15A:
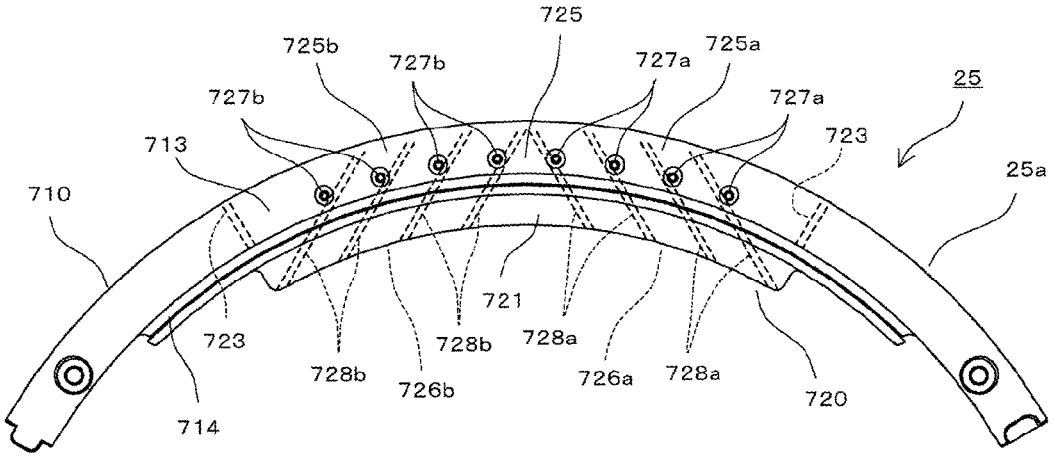
FIG. 15*a* is a diagram illustrating a structure of a retainer unit in a change example 2 of embodiment 1.
Figure 15B:
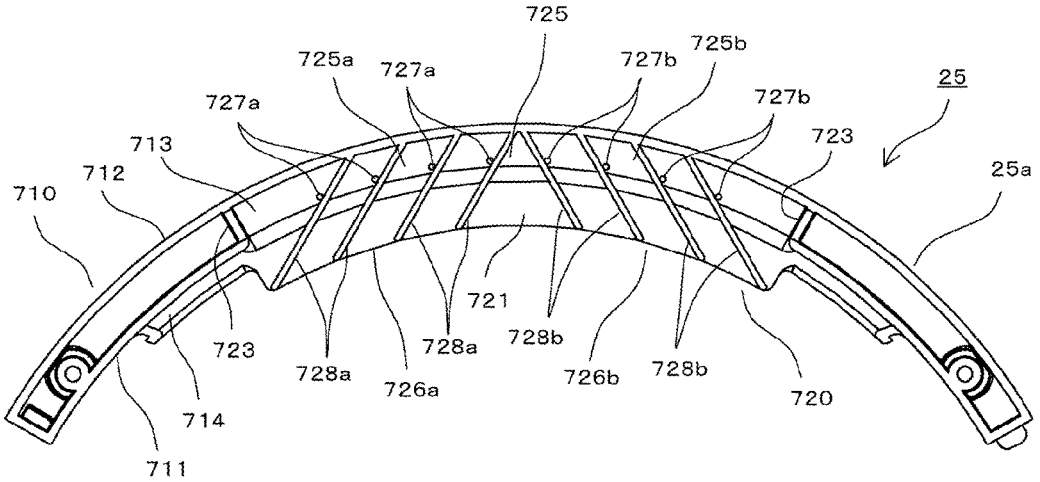
FIG. 15*b* is a second diagram illustrating a structure of a retainer unit in a change example 2 of embodiment 1.

FIGS. 15*a* and 15*b* are diagrams illustrating a composition of the retainer unit 25 in the present change example. FIG. 15*a* is a front view illustrating the annular components 25*a* forming the retainer unit 25. FIG. 15*b* is a rear view illustrating the annular components 25*a*.

In the present change example, first guide ribs 728*a* are formed in a manner of distributing along each of the first outflow ports 727*a* in the first water storage part 725*a* on the water storage shells 720. Each of the first guide ribs 728*a* obliquely extends from the periphery of the retainer 710 towards the advancing direction of the drum 22 during right-hand rotation. In addition, second guide ribs 728*b* are formed in a manner of distributing along each of the second outflow ports 727*b* in the second water storage part 725*b* on the water storage shells 720. Each of the second guide ribs 728*b* obliquely extends from the periphery of the retainer 710 towards the advancing direction of the drum 22 during left-hand rotation. The first water storage part 725*a* and the second water storage part 725*b* are separated by the first guide ribs 728*a* and second guide ribs 728*b* positioned on a center side of the water storage shells 720 instead of the central separating plate 724. The first guide ribs 728*a* and the second guide ribs 728*b* are equivalent to the guide ribs of the present disclosure.

The front surface plate 722 is not configured on the water storage shells 720, the first intake ports 726*a* are integrally formed on the inner circumferential surface on the side of the first water storage part 725*a* of the water storage shells 720, and the second intake ports 726*b* are integrally formed on the inner circumferential surface on the side of the second water storage part 725*b* of the water storage shells 720.

Figure 16:
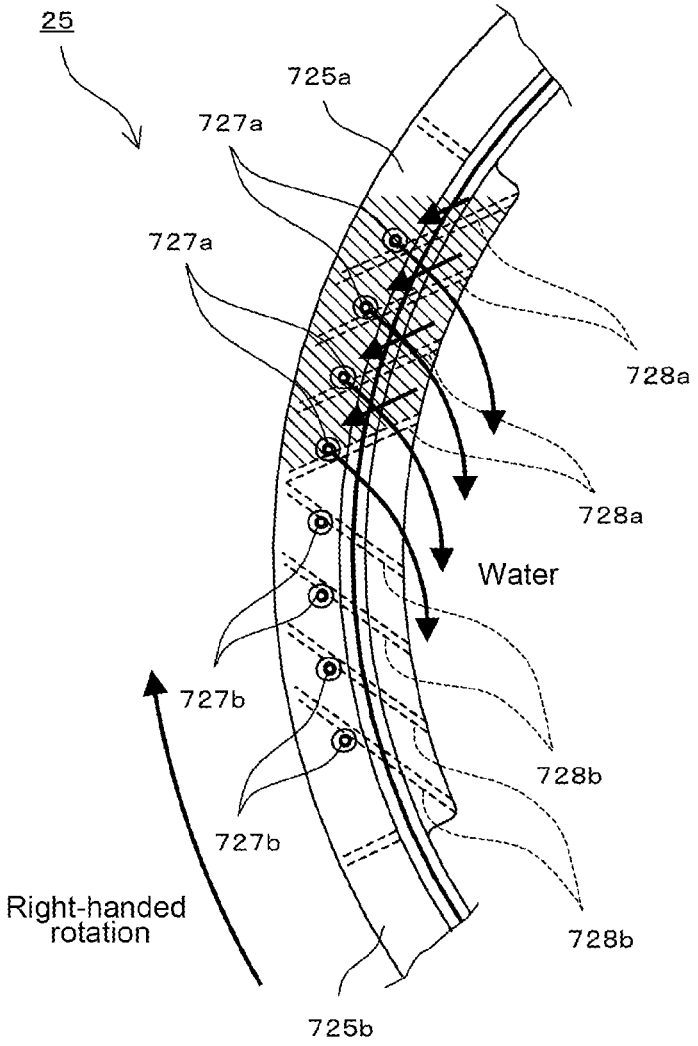
FIG. 16 is a diagram schematically illustrating an outflow shape of water stored in a first water storage part in a change example 2 of embodiment 1.

FIG. 16 is a diagram schematically illustrating an outflow shape of the water stored in the first water storage part 725*a*. Although FIG. 16 is a diagram illustrating the shape of the drum 22 during right-hand rotation, the drum 22 has the same shape during left-hand rotation.

In the present change example, the drum 22 alternately rotates from left to right in the wetting process. As shown in FIG. 16, when the first water storage part 725*a* moves to the upper part through the right-hand rotation of the drum 22, the water stored in the first water storage part 725*a* when the first water storage part 725*a* is soaked in water in the outer tank 20 flows out of the first outflow ports 727*a*. Then, the water in the first water storage part 725*a* flows along the first guide ribs 728*a* and smoothly flows to the first outflow ports 727*a*. The stirring body 24 and the washings in contact with the stirring body 24 are wetted by the water flowing out of the first outflow ports 727*a*.

Similarly, when the second water storage part 725*b* moves to the upper part through the left-hand rotation of the drum 22, the water stored in the second water storage part 725*b* when the second water storage part 725*b* is soaked in water in the outer tank 20 flows out of the second outflow ports 727*b*. Then, the water in the second water storage part 725*b* flows along the second guide ribs 728*b* and smoothly flows to the second outflow ports 727*b*. The stirring body 24 and the washings in contact with the stirring body 24 are wetted by the water flowing out of the second outflow ports 727*b*.

According to the structure of the present change example, since the water in the first water storage part 725*a* can be smoothly guided to the first outflow ports 727*a* by virtue of the first guide ribs 728*a*, the water can well flow towards the stirring body 24 from the first outflow ports 727*a*. Similarly, since the water in the second water storage part 725*b* can be smoothly guided to the second outflow ports 727*b* by virtue of the second guide ribs 728*a*, the water can well flow towards the stirring body 24 from the second outflow ports 727*b*.

Embodiment 2

In the present embodiment, the water supply mechanism part is configured on the stirring body 24.

Figure 17:
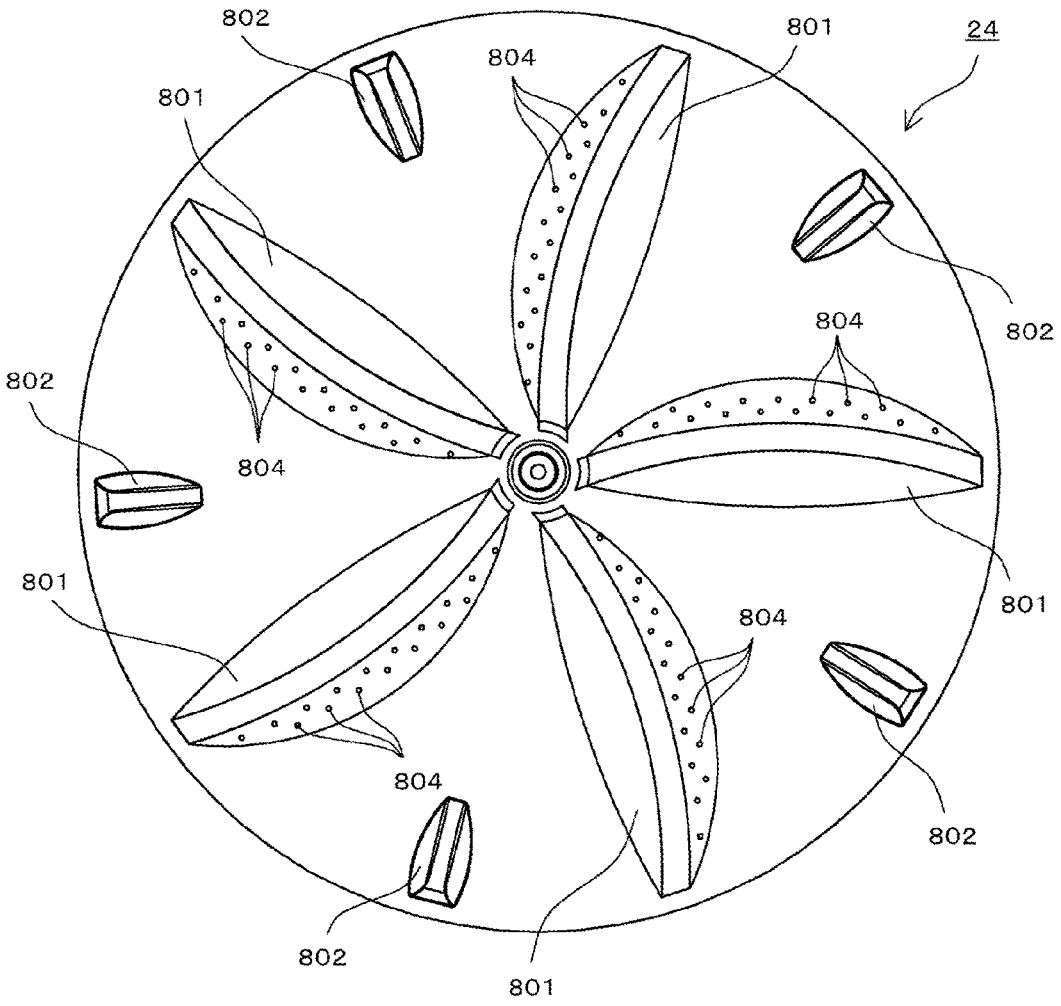
FIG. 17 is a diagram illustrating a structure of a stirring body in embodiment 2.
Figure 18:
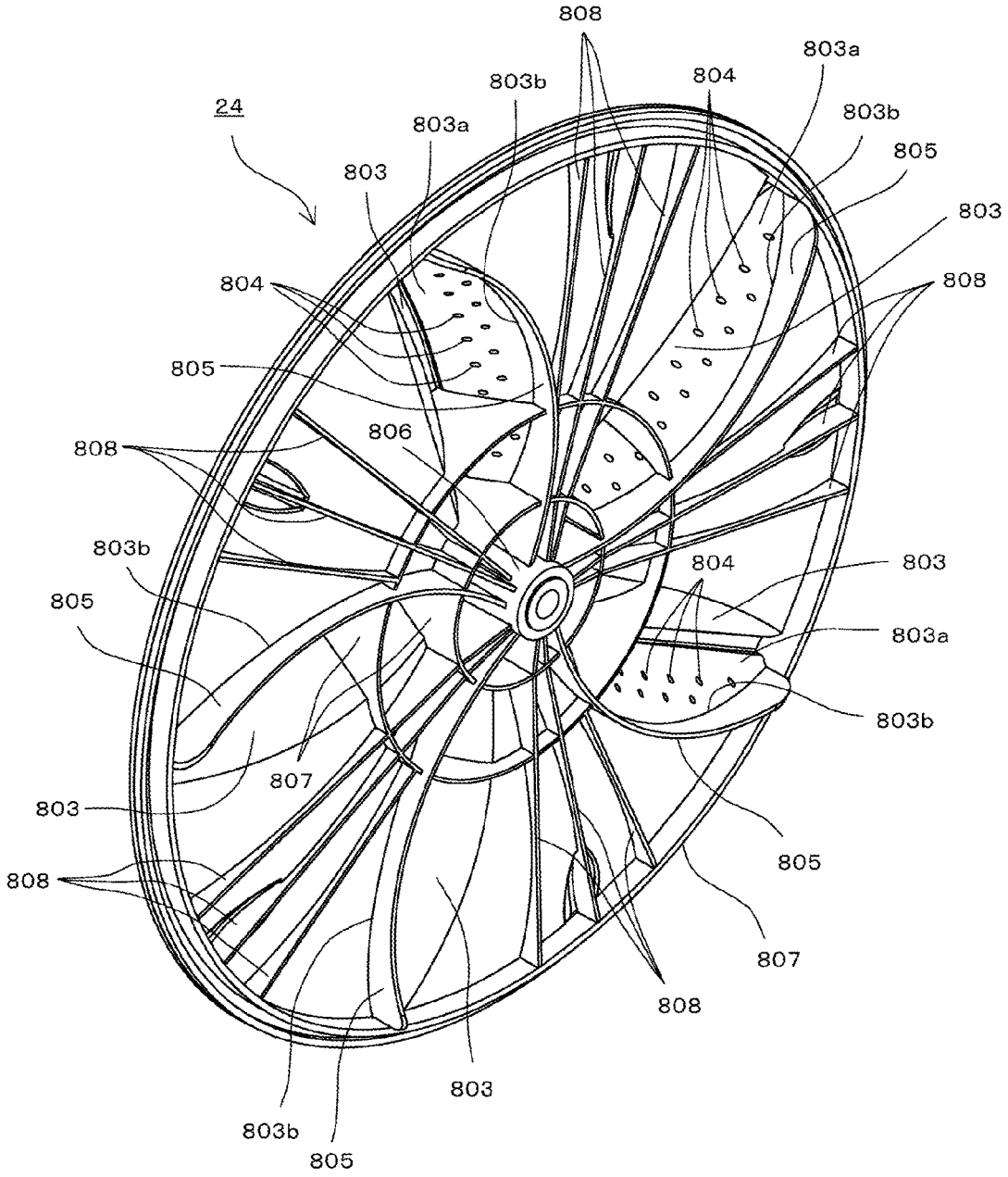
FIG. 18 is a diagram illustrating a structure of a stirring body in embodiment 2.

FIG. 17 and FIG. 18 are diagrams illustrating a structure of the stirring body 24 in the present change example. FIG. 17 is a front view illustrating the stirring body 24, and FIG. 18 is a rear three-dimensional view illustrating the stirring body 24.

The stirring body 24 is made from polypropylene and other resin materials. A plurality of main blades 801 and a plurality of auxiliary blades 802 are formed in the surface of the stirring body 24. Shapes of the surfaces of the main blades 801 and the auxiliary blades 802 are respectively the same as those of the main blades 24*a* and auxiliary blades 24*b* in the embodiment 1.

As shown in FIG. 18, on the back side of the stirring body 24, in order to enable the wall thicknesses of the main blades 801 to be uniform, recess parts 803 are formed in the back of the main blades 801 corresponding to protrusions on the surfaces of the main blades 801.

A concave curved shape relative to the advancing direction is formed in a wall surface 803*a* on the rear side, which forms the advancing direction during right-hand rotation of the stirring body 24, of each of the recess parts 803. A plurality of water through holes 804 leading to the surface of the stirring body 24 are formed in the wall surfaces 803*a*. The water through holes 804 are equivalent to the outflow ports of the present disclosure. Water scooping ribs 805 are formed in the back of the stirring body 24 along edge parts 803*b* of the wall surfaces 803*a*.

A fixing hub 806 for fixing the wing shaft 200 is formed in the central part of the back of the stirring body 24. In addition, in order to mainly improve the strength of the stirring body 24, a plurality of annular first reinforcing ribs 807 concentric with the fixing hub 806 and a plurality of second reinforcing ribs 808 extending radially towards the radial direction of the stirring body 24 are formed in the back of the stirring body 24.

The water supply mechanism part is composed of the recess parts 803 formed in the back of the stirring body 24, the water through holes 804 and the water scooping ribs 805.

Figure 19:
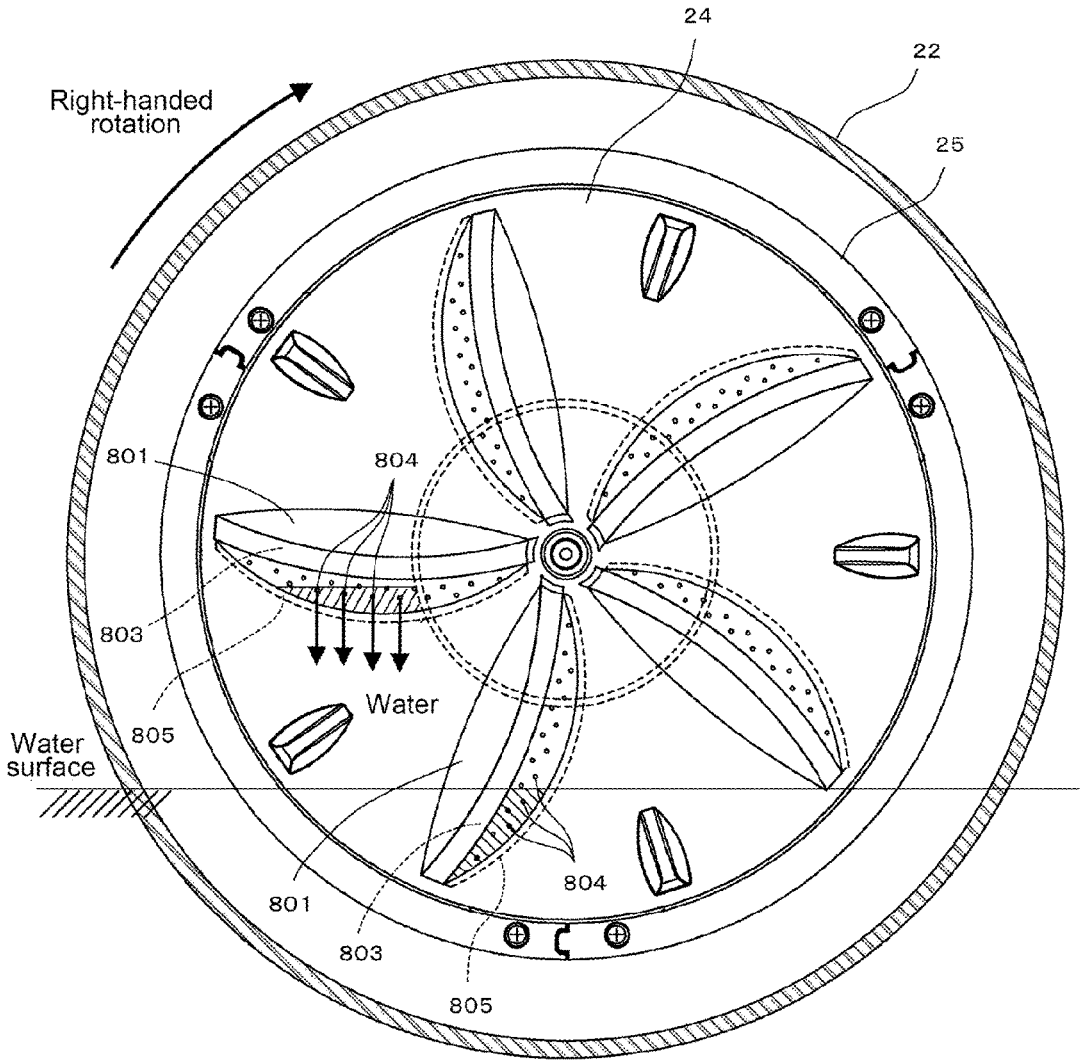
FIG. 19 is a diagram schematically illustrating a shape of washings wetted by a wetting process in embodiment 2.

FIG. 19 is a diagram schematically illustrating a shape of the washings wetted in the wetting process.

In the wetting process of the present embodiment, the drum 22 and the stirring body 24 perform right-hand rotation. As shown in FIG. 19, along with rotation of the stirring body 24, one part of the front end side of the main blades 801, namely the recess parts 803, are soaked in the water in the outer tank 20. When the recess parts 803 are soaked in the water stored in the outer tank 20, the water in the outer tank is scooped by the water scooping ribs 805 and stored in the recess parts 803. Then, due to the concave curved shape, the water scooping ribs 805 can perform functions like a bucket, and the water in the outer tank 20 is easily scooped by the water scooping ribs 805, and easily stored in the recess parts 803. When the recess parts 803 are lifted up from the water, the water stored in the recess parts 803 flows out of the water through holes 804 and is splashed to the surface of the stirring body 24.

In this way, the stirring body 24 and the washings in contact with the stirring body 24 are wetted, thereby reducing the friction force therebetween.

In addition, in order to prevent the washings from twining, the drum 22 and the stirring body 24 can occasionally perform left-hand rotation.

In addition, in the present embodiment, a water supply mechanism part with the same structure as that in the embodiment 1 can be configured on the retainer unit 25.

Effects of Embodiment 2

According to the present embodiment, as mentioned in the embodiment 1, the friction force produced between the stirring body 24 and the washings in contact with the stirring body 24 can be reduced, and locking of the driving motor 100 and cloth damage of the washings can be prevented.

In addition, according to the present embodiment, the water stored in the outer tank 20 can be drawn up by virtue of the recess parts 801 and splashed to the surface of the stirring body 24, and the surface of the stirring body 24 can be wetted by utilizing the water in the outer tank 20.

In addition, according to the present embodiment, in order to enable wall thicknesses of the main blades 24*a* to be uniform, the recess parts 803 formed in the back of the stirring body 24 necessarily serve as the water storage part, so the water supply mechanism part can be simply and conveniently realized.

In addition, according to the present embodiment, since the water in the outer tank 20 can be drawn up by utilizing rotation of the stirring body 24, the water in the outer tank 20 can be easily utilized.

Change Example of Embodiment 2

Figure 20:
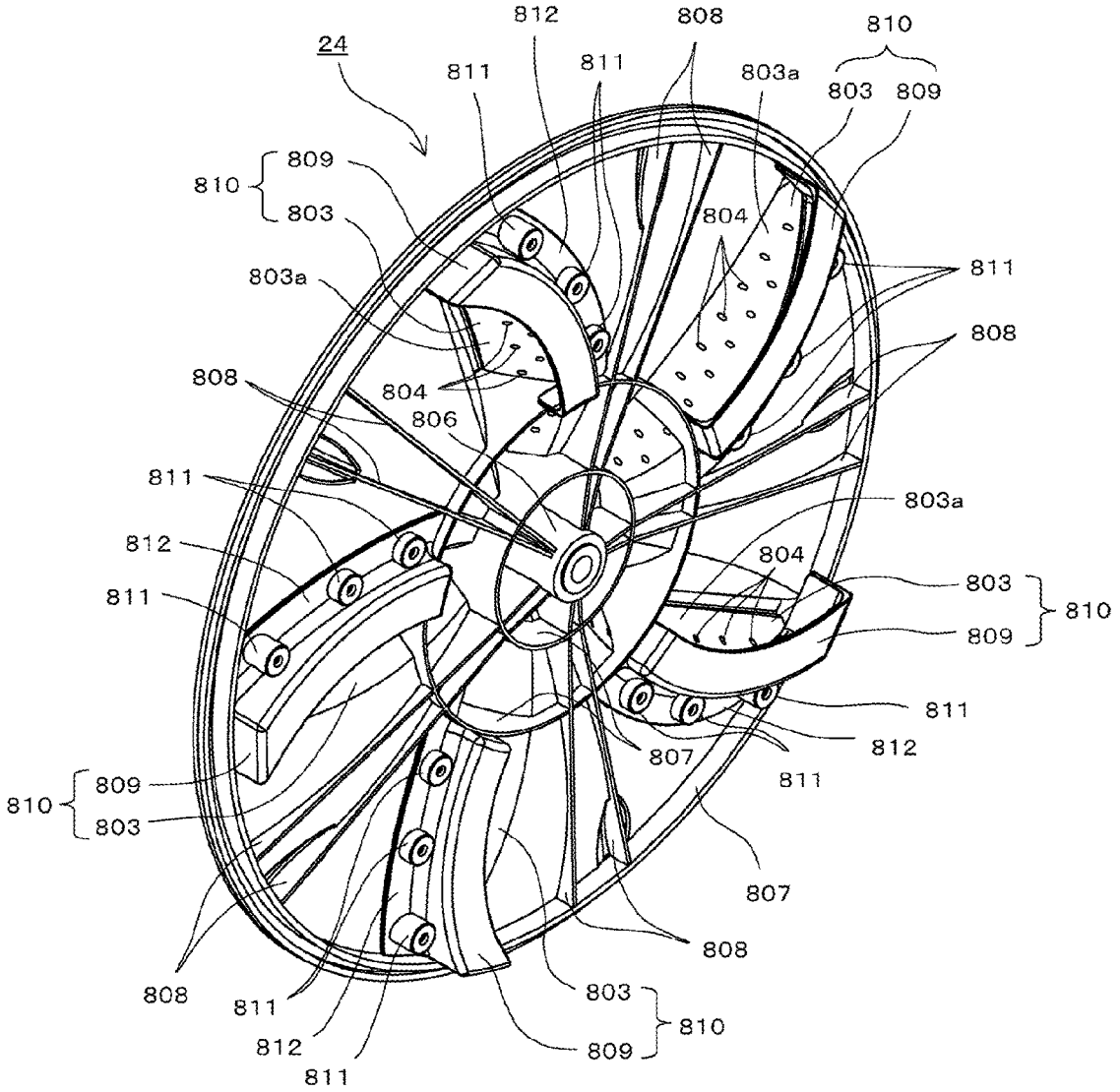
FIG. 20 is a diagram illustrating a structure of a stirring body in a change example of embodiment 2.

FIG. 20 is a back three-dimensional view illustrating a structure of the stirring body 24 in the present change example.

In the present change example, the recess parts 803 are not provided with the water scooping ribs 805. Instead, in the present change example, the recess parts 803 are covered by a water storage cover 809, and a water storage part 810 is formed by the recess parts 803 and the water storage cover 809 on the back of the stirring body 24. An opening is formed in the upper surface of the water storage part 810. The water storage cover 809 is provided with a flange part 812 on which a plurality of mounting flanges 811 are formed. The mounting flanges 811 are fixed by screws which are not shown in figures, and the water storage cover 809 is fixed on the back of the stirring body 24.

Figure 21:
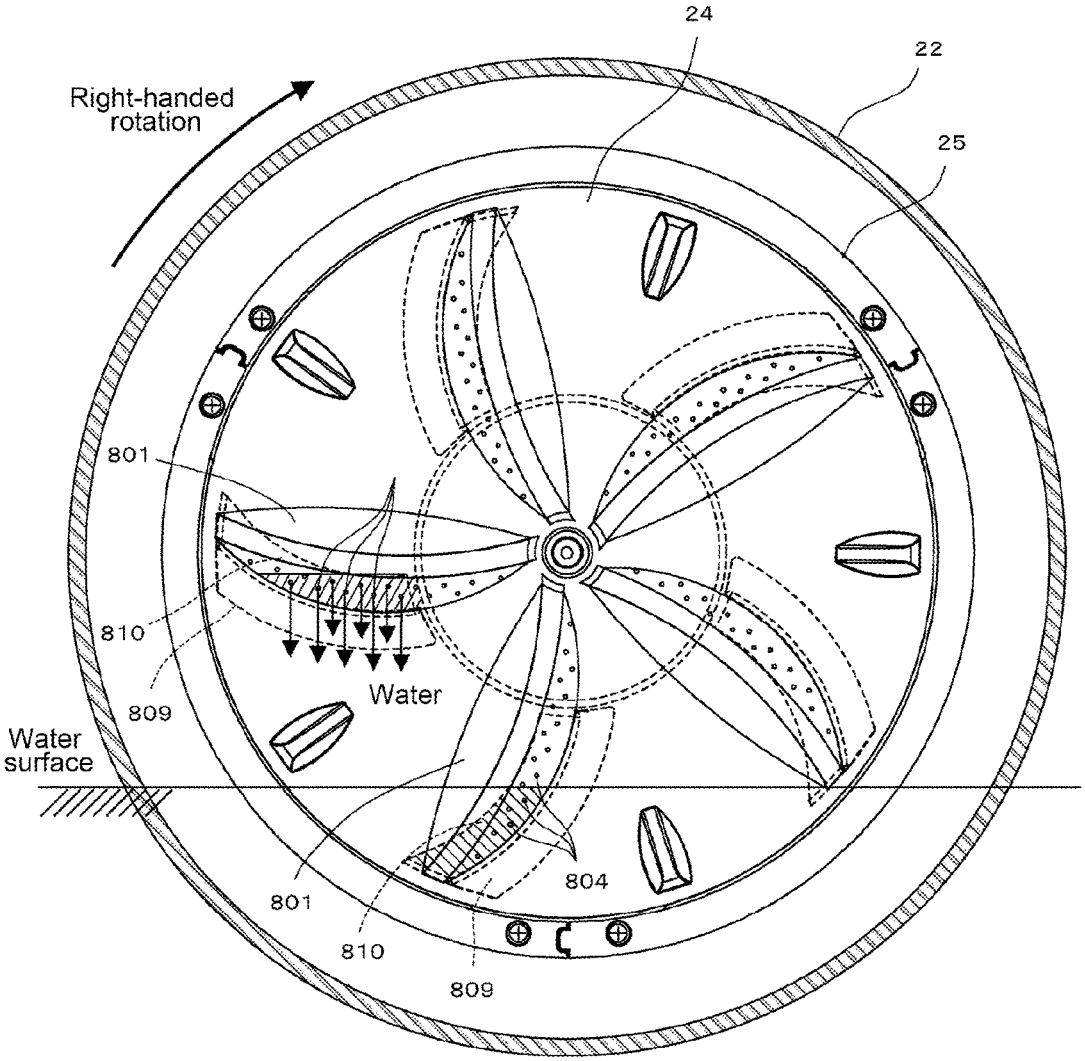
FIG. 21 is a diagram schematically illustrating a shape of washings wetted by a wetting process in a change example of embodiment 2.

FIG. 21 is a diagram schematically illustrating a shape of the washings wetted by a wetting process.

As shown in FIG. 21, one part of the front end side of the flange part 812 is soaked in the water in the outer tank 20 along with rotation of the stirring body 24. The water stored in the outer tank 20 is scooped through the one part and stored in the water storage part 810. When the water storage part 810 leaves from the water and is lifted up, the water stored in the water storage part 810 flows out of the water through holes 804 and is splashed to the surface of the stirring body 24.

In this way, the stirring body 24 and the washings in contact with the stirring body 24 are wetted, thereby reducing the friction force therebetween.

According to the change example, more water can be scooped by the water storage part 810 at a time and then stored, and more water can be splashed to the surface of the stirring body 24 at a time.

Embodiment 3

In the present embodiment, baffles 900 configured to perform functions of the water supply mechanism part are configured on the inner circumferential surface of the drum 22.

Figure 22A:
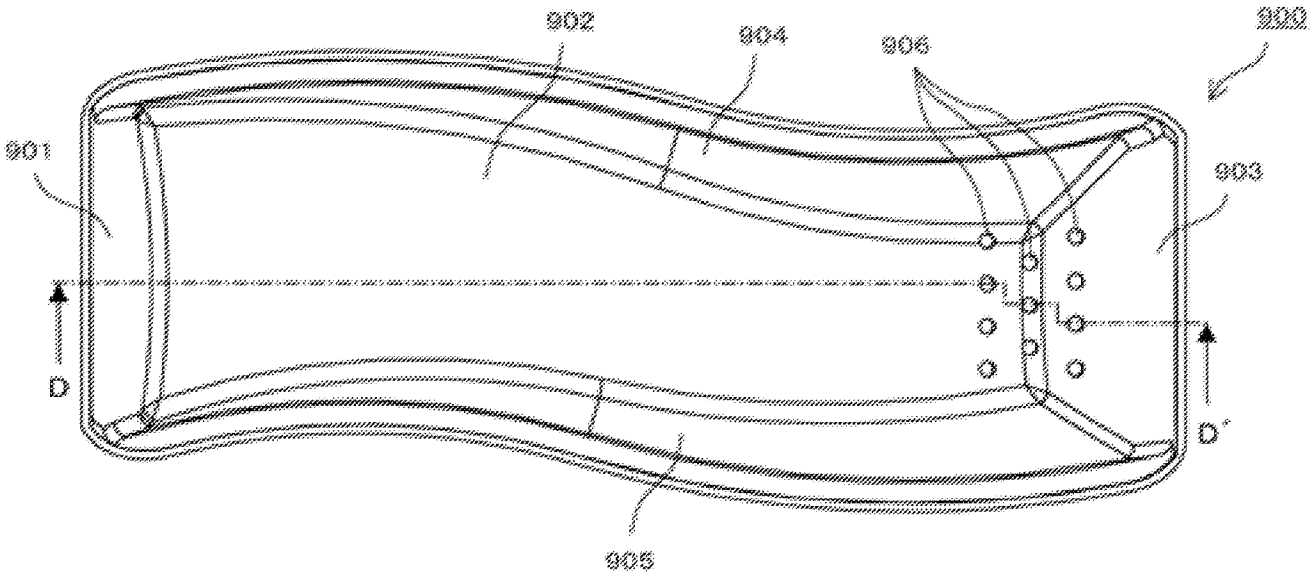
FIG. 22*a* is a diagram illustrating a structure of baffles in embodiment 3.
Figure 22B:
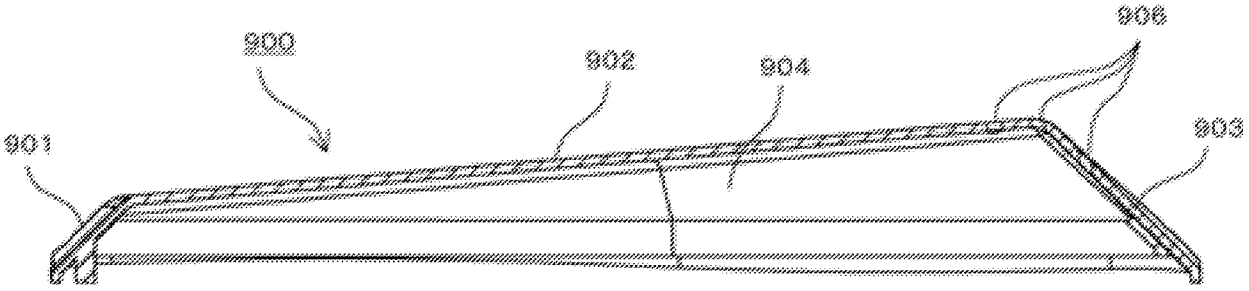
FIG. 22*b* is a second diagram illustrating a structure of baffles in embodiment 3.
Figure 23B:
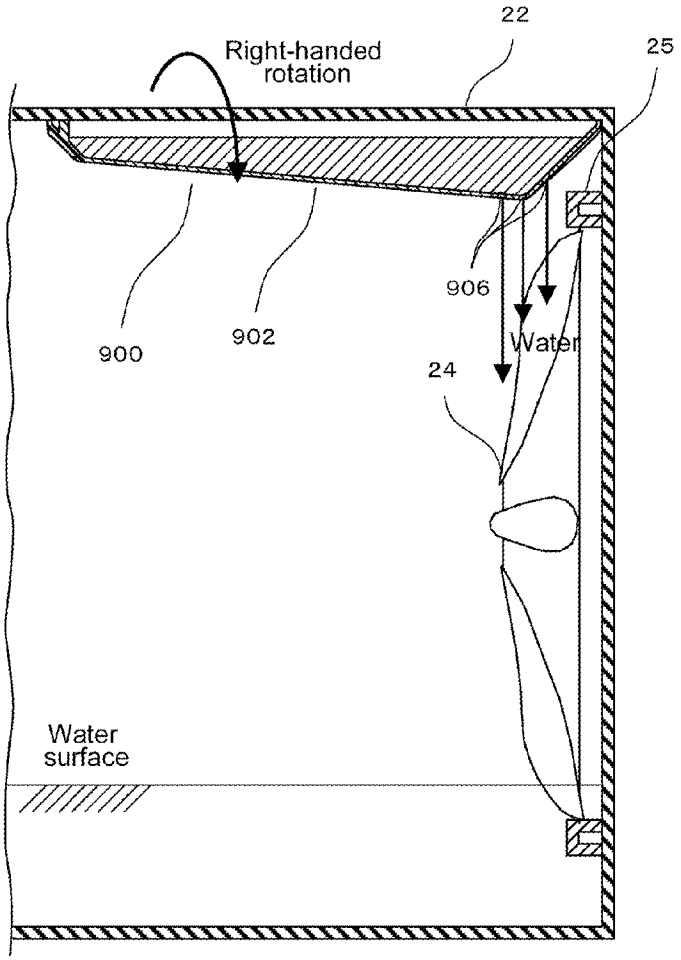
FIG. 23*b* is second diagram illustrating a shape of water in an outer tank stored in baffles and a shape of water from baffles flowing out to wet a stirring body in embodiment 3.
Figure 23A:
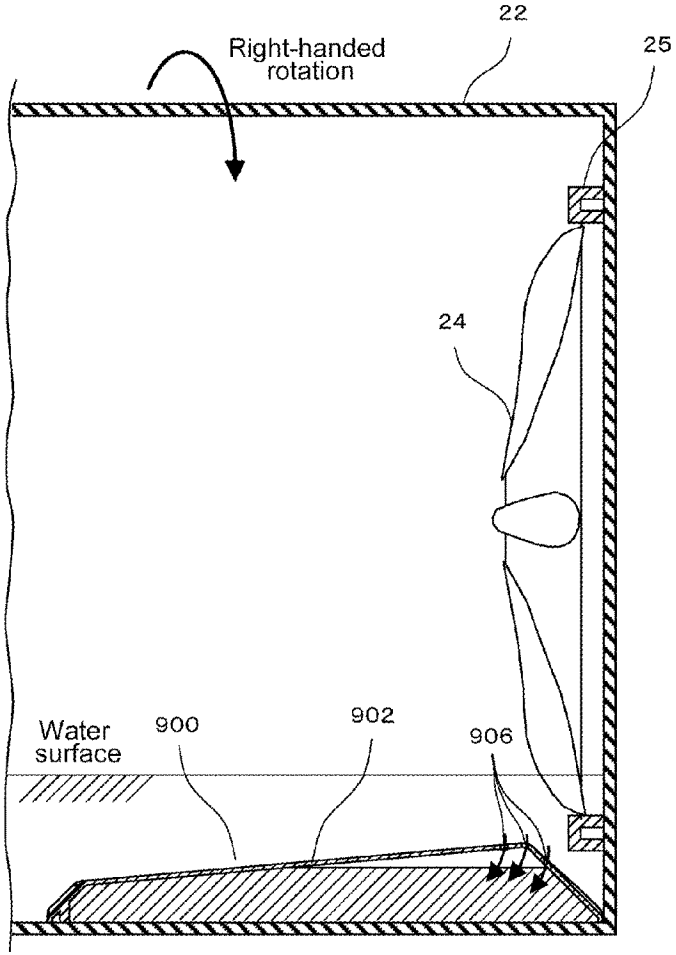
FIG. 23*a* is a diagram illustrating a shape of water in an outer tank stored in baffles and a shape of water from baffles flowing out to wet a stirring body in embodiment 3.

FIGS. 22*a* and 22*b* are diagrams illustrating a structure of the baffles 900 in the present embodiment. FIG. 22*a* is a vertical view illustrating the baffles 900, and FIG. 22*b* is a D-D' sectional view of FIG. 22*a*. FIGS. 23*a* and 23*b* are respectively diagrams illustrating a shape of the water in the outer tank 20 stored in the baffles 900 and a shape of the water 900 flowing out from the baffles and the wetted stirring body 24.

The baffles 900 have a lengthwise hollow box shape of which the lower surface is opened. Front surfaces 901 of the baffles 900 are slightly inclined backwards, upper surfaces 902 of the baffles 900 are inclined in a manner of becoming higher and higher towards the rear part, and rear surfaces 903 of the baffles 900 are slightly inclined to the front part. In addition, left side faces 904 of the baffles 900 are slightly inclined towards the right, and right side faces 905 of the baffles 900 are slightly inclined towards the left. In addition, when looking down from above, the upper surfaces 902, the left side surfaces 904 and the right side surfaces 905 of the baffles 900 are small and bent into an S shape.

A plurality of water through holes 906 are formed in corners formed by the upper surfaces 902 and the rear surfaces 903 at the baffles 900. The water through holes 906 are equivalent to the outflow ports of the present disclosure.

Three baffles 900 are configured on the inner circumferential surface of the drum 22 at roughly equal intervals. In the three baffles 900 in FIGS. 23*a* and 23*b*, only one baffle 900 is shown, and the residual baffles 900 are not shown. As shown in FIGS. 23*a* and 23*b*, the lower surfaces of the baffles 900 are closed by the inner circumferential surface of the drum 22 when the baffles 900 are mounted on the inner circumferential surface of the drum 22. The water through holes 906 are formed in positions, through which the water flowing out of the water through holes 906 is splashed to the surface of the stirring body 24, of the baffles 900, for example, formed in positions where the front and rear directions of the drum 22 and the stirring body 24 are overlapped.

In the wetting process of the present embodiment, the drum 22 alternately rotates from left to right. As shown in FIG. 22*a*, when the baffles 900 move to the lower positions along with rotation of the drum 22, the baffles 900 are soaked in the water in the outer tank 20. The water through holes 906 serve as water intake ports to perform functions, and water can be taken from the water through holes 906 and stored in the baffles 900. As shown in FIG. 22*b*, when the baffles 900 extend out of the water and ascend, the water stored in the baffles 900 flows out of the water through holes 906 and is splashed to the surface of the stirring body 24. When the baffles 900 ascend to the upper part and stand upside down, the upper surfaces 902 are inclined in a manner of lowering the rear side. Therefore, the water in the baffles 900 easily flows to the rear part of the baffles 900 and then easily flows out of the water through holes 906.

In this way, the stirring body 24 and the washings in contact with the stirring body are wetted by the water flowing out of the water through holes 906, so that the friction force between the stirring body and the washings can be reduced.

In addition, the upper surfaces 902 of the baffles 900 may be not inclined under the condition that a structure that the drum 22 is inclined relative to the horizontal axis in a manner of lowering the rear surface side is adopted. In this case, by tilting the drum 22, the water in the baffles 900 easily flows towards the rear part of the baffles 900 and easily flows out of the water through holes 906.

In addition, in the present embodiment, a water supply mechanism part with the same structure as that in the embodiment 1 can be configured on the retainer unit 25. Further, a water supply mechanism part with the same structure as that in the embodiment 2 can be configured on the stirring body 24.

Effects of Embodiment 3

According to the embodiment, as mentioned in the embodiment 1, the friction force produced between the stirring body 24 and the washings in contact with the stirring body 24 can be reduced, and locking of the driving motor 100 and cloth damage of the washings can be prevented.

In addition, according to the present embodiment, the water stored in the outer tank 20 can be drawn up by virtue of the baffles 900 and splashed to the surface of the stirring body 24, and the surface of the stirring body 24 can be wetted by utilizing the water in the outer tank 20.

In addition, according to the present embodiment, since the baffles 900 configured to stir the washings can serve as the water storage part, the water supply mechanism part can be simply and conveniently realized.

In addition, according to the present embodiment, since the water in the outer tank 20 can be drawn up by utilizing rotation of the drum 22, the water in the outer tank 20 can be easily utilized.

Change Example of Embodiment 3

In the above embodiment 3, the water through holes 906 serving as the intake ports may be further provided with intake ports different from the water through holes 906.

Figure 24A:
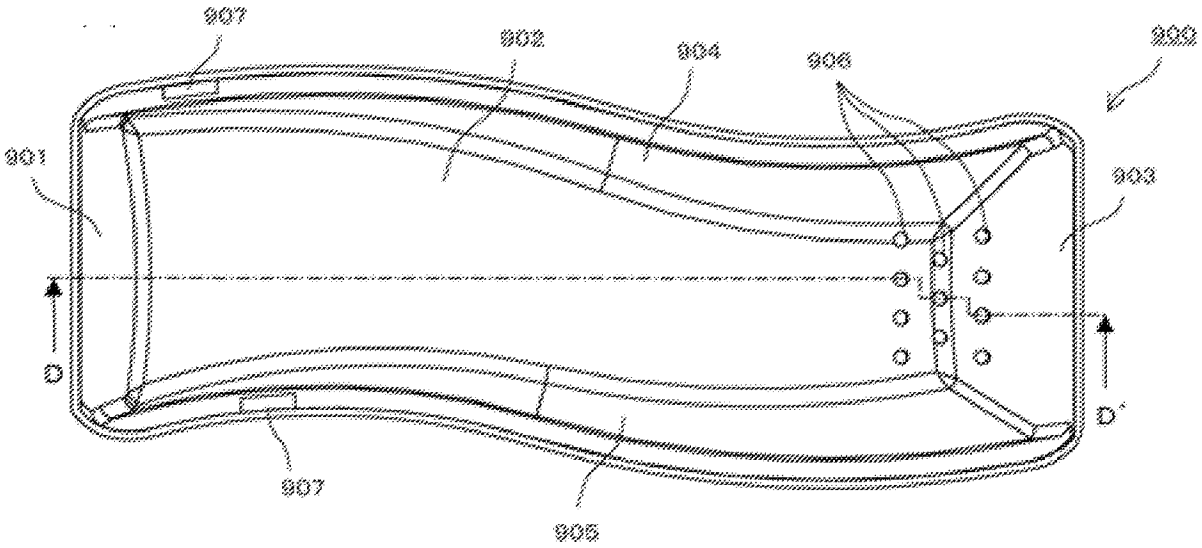
FIG. 24*a* is a diagram illustrating a structure of baffles in a change example of embodiment 3.
Figure 24B:
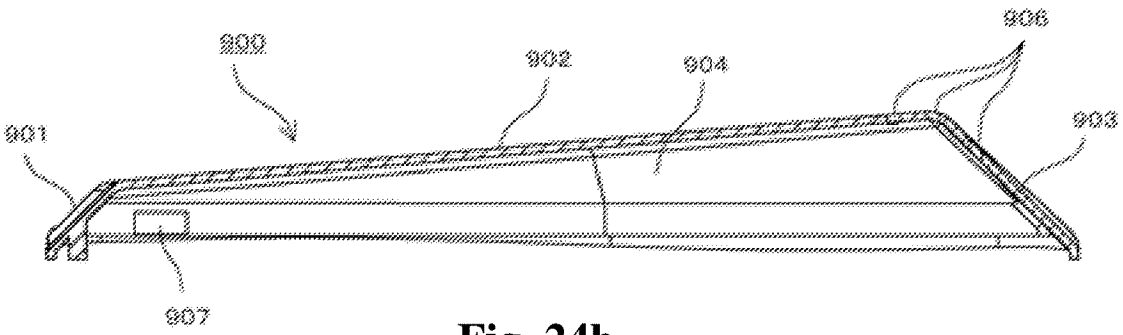
FIG. 24*b* is a second diagram illustrating a structure of baffles in a change example of embodiment 3.

FIGS. 24*a* and 24*b* are diagrams illustrating a structure of the baffles 900 in the present change example. At the baffles 900 of the present change example, intake ports 907 are respectively formed in the front parts of the left side surfaces and right side surfaces 905 of the baffles 900. Under the condition that the intake ports 907 are formed in the positions, the intake ports 907 are opened towards the advancing direction of the drum 22 while rotating, and water is easily taken from the intake ports 907. In addition, when the baffles 900 ascend to the upper part, the water is difficult to leak from the intake ports 907. In addition, the two intake ports 907 are formed in a slightly staggered manner in the front and rear directions, and water taken from the intake port 907 in one side is difficult to leak from the intake port 907 in the other side.

Other Change Examples

Although one embodiment of the present disclosure is described above, a specific structure of each part is not only limited to the above implementation mode. In addition, embodiments of the present disclosure may be subjected to various modifications in addition to the description above.

Figure 25B:
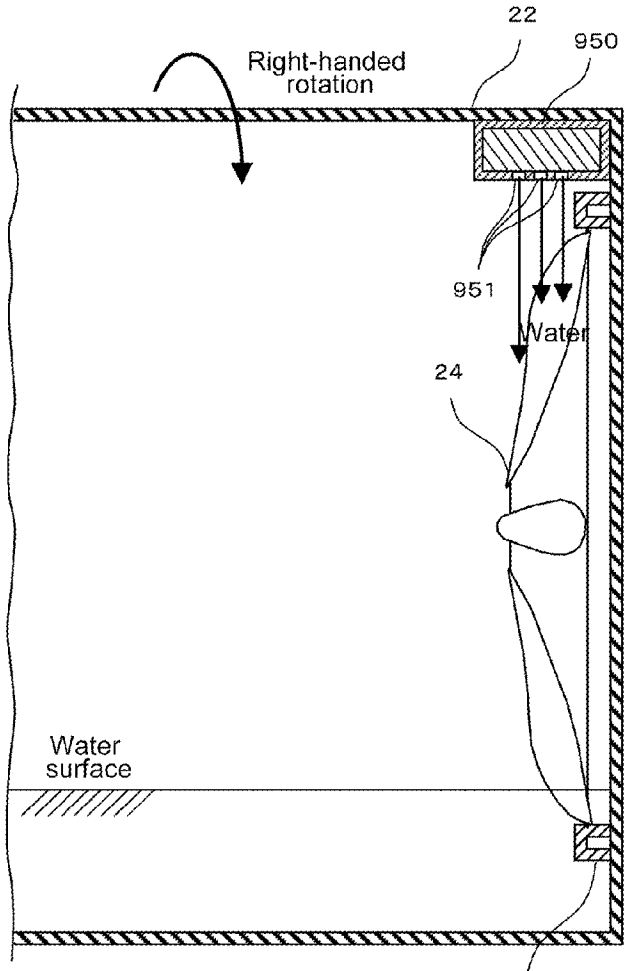
FIG. 25*b* is a second diagram illustrating a structure of a water storage part in other change examples.
Figure 25A:
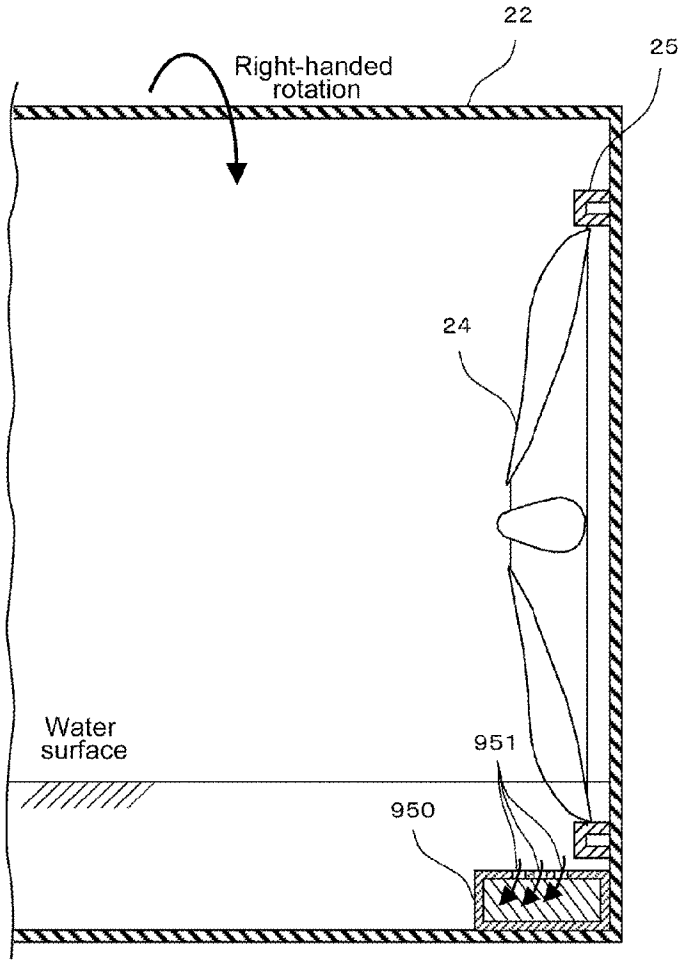
FIG. 25*a* is a diagram illustrating a structure of a water storage part in other change examples.

For example, in the embodiment 3 of the above implementation mode, the baffles 900 serving as the water supply mechanism part perform the functions. However, as shown in FIGS. 25*a* and 25*b*, different from the baffles 900, the water storage parts 950 forming the water supply mechanism part may be formed in the rear part of the inner circumferential surface of the drum 22. For example, the water storage parts 950 are composed of hollow box structures, and provided with water through holes 951 forming intake ports and outflow ports on surfaces opposite to the stirring body 24. Although only one water storage part 950 is shown in FIGS. 25*a* and 25*b*, more than two water storage parts 950 may be configured at roughly equal intervals.

As shown in FIG. 25*a*, when moving to the lower position along with rotation of the drum 22, the water storage part 950 is soaked in the water in the outer tank. The water is taken from the water through holes 951 and stored in the water storage part 950. As shown in FIG. 25*b*, when the water storage part 950 comes out of the water and ascends to the upper part, the water stored in the water storage part 950 flows out of the water through holes 951 and is splashed to the surface of the stirring body 24. The stirring body 24 and the washings in contact with the stirring body 24 are wetted, so that the friction force therebetween is reduced.

Figure 26B:
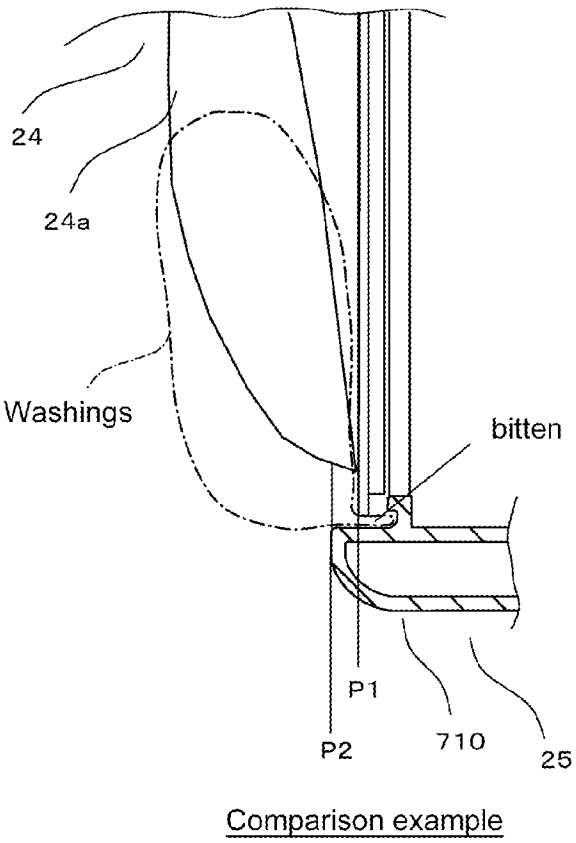
FIG. 26*b* is a second diagram used for illustrating a drum washing machine in other change examples.
Figure 26A:
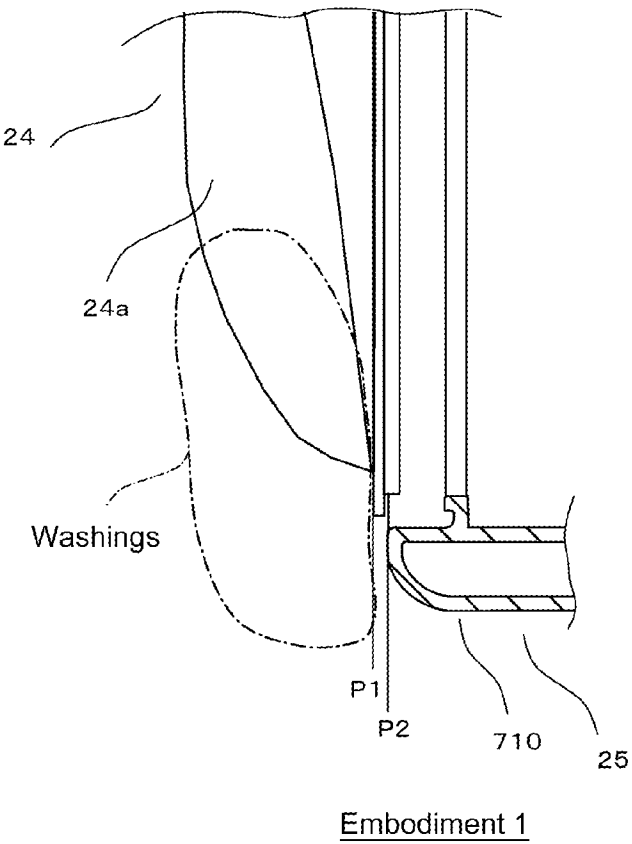
FIG. 26*a* is a diagram used for illustrating a drum washing machine in other change examples.

Further, in the above embodiment, as shown in FIG. 26*a* for example, the stirring body 24 and the retainer unit 25 are mounted on the rear surface of the drum 22 in a manner that a position P1 on the surface of the stirring body 24 is positioned in the front compared with a position P2 on the front surface of the retainer 710. As shown in comparison examples in FIG. 26*b*, the washings stirred by the stirring body 24 are in contact with the inner circumferential surface of the retainer 710 and are guided by the inner circumferential surface under the condition that the position P2 on the front surface of the retainer 710 is positioned in the front compared with the position P1 on the surface of the stirring body 24, so that the washings are easily clamped between the stirring body 24 and the retainer 710. That is, the washings are easily bitten between the stirring body 24 and the retainer 710, and may be damaged. In this regard, the washings are not in contact with the inner circumferential surface of the retainer 710 under the condition that a structure that the position P1 on the surface of the stirring body 24 is positioned in the front compared with the position P2 on the front surface of the retainer 710 is made, and the washings are difficult to be bitten between the stirring body 24 and the retainer 710.

Further, in the above embodiment, the drum 22 rotates by taking the horizontal axis as center. However, the drum washing machine 1 may be made into a structure that the drum 22 rotates by using an inclination axis inclining relative to a horizontal direction as a center. In this case, for example, the inclination angle of the outer tank 20 and the drum 22 may be about 10-20 degrees.

Further, although the drum washing machine 1 in the above embodiment does not have a drying function, the present disclosure also can be applied to a drum washing machine with the drying function, that is, a drum washing and drying machine.

In addition, embodiments of the present disclosure can be subjected to various changes within the scope of technical idea shown in claims.

What is claimed is:

1. A drum washing machine, comprising:

an outer tank, configured in a shell;

a drum, configured in the outer tank and capable of rotating by using a horizontal axis or an inclination axis inclining relative to a horizontal direction as a center;

a rotating body, configured at a rear part of the drum and provided with a protruding part configured to be in contact with washings on a surface of the rotating body;

a driving part, configured to enable the drum and the rotating body to rotate at different rotating speeds; and a water supply mechanism part, capable of splashing water to the surface of the rotating body;

wherein the water supply mechanism part comprises: a water storage part, configured on the rear part of the drum, and configured to move between a position of water soaked in the outer tank and a position higher than the water in the outer tank and store water when soaked in water of the outer tank; and an outflow port, configured on the water storage part, and configured to enable the water stored in the water storage part to flow out to the surface of the rotating body at an upper position;

wherein the protruding part extends radially from center of the rotating body to an outer circumference part of water soaked in the outer tank.

2. The drum washing machine according to claim 1, wherein the water storage part is configured to move through rotation of the drum.

3. The drum washing machine according to claim 2, wherein the water supply mechanism part comprises an intake port configured at the water storage part and configured to take water in the outer tank into the water storage part, and the intake port is opened to an advancing direction side of the drum while rotating.

4. The drum washing machine according to claim 3, wherein guide ribs capable of guiding water to the outflow port when the water flows out of the outflow port are configured in the water storage part.

5. The drum washing machine according to claim 2, wherein guide ribs capable of guiding water to the outflow port when the water flows out of the outflow port are configured in the water storage part.

6. The drum washing machine according to claim 1, wherein guide ribs capable of guiding water to the outflow port when the water flows out of the outflow port are configured in the water storage part.

7. The drum washing machine according to claim 1, wherein a recess part is formed in a back corresponding to the protrusion on the surface of the protruding part, the water storage part comprises the recess part and moves through rotation of the rotating body, and the outflow port is formed in the recess part.

8. The drum washing machine according to claim 1, wherein hollow baffles are configured on an inner circumferential surface of the drum, the water storage part comprises the baffles and moves through rotation of the drum, and at the baffles, the outflow port is configured at a position where water flowing out of the outflow port is splashed to the surface of the rotating body.

* * * * *